US006517193B2

(12) United States Patent
Kimura

(10) Patent No.: US 6,517,193 B2
(45) Date of Patent: Feb. 11, 2003

(54) INK JET HEAD, MANUFACTURING METHOD THEREOF, AND INK JET PRINTING APPARATUS

(75) Inventor: Isao Kimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/994,868

(22) Filed: Nov. 28, 2001

(65) Prior Publication Data

US 2002/0071003 A1 Jun. 13, 2002

(30) Foreign Application Priority Data

Nov. 30, 2000 (JP) ..... 2000-366289
Nov. 30, 2000 (JP) ..... 2000-366290

(51) Int. Cl.[7] ..... B41J 2/06
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 4,057,807 A 11/1977 Fischbeck et al.
5,521,621 A 5/1996 Endo et al. ..... 347/15

FOREIGN PATENT DOCUMENTS

DE 32 45 283 6/1984
JP 47-2006 2/1972
JP 54-59936 5/1979
JP 62-9431 1/1987
JP 5-24189 2/1993
JP 5-55043 3/1993
JP 6-8449 1/1994

OTHER PUBLICATIONS

Patent Abstracts of Japan, vol. 004, No. 116 (M–027), Aug. 08, 1980 (JP 55073571, Jun. 03, 1980).
Patent Abstracts of Japan, vol. 004, No. 102 (M–022), Jul. 22, 1980 (JP 55 059972, May 6, 1980).
Patent Abstracts of Japan, vol. 017, No. 248 (M–1411), May 18, 1993 (JP 04368851, Dec. 21, 1992).
Patent Abstracts of Japan, vol. 017, No. 353 (E–1393), Jul. 05, 1993 (JP 05 055043, Mar. 05, 1993).

*Primary Examiner*—Raquel Yvette Gordon
(74) *Attorney, Agent, or Firm*—Fitzpatrick, Cella, Harper & Scinto

(57) ABSTRACT

An ink jet head has an element formed on a substrate, having a laminated structure, and comprising a small-sized electromagnet having a coil and a core, electrodes for conducting electricity through the electromagnet, a film that isolates the electromagnet and the electrodes from ink, and a displacing plate having of magnetic materials located opposite the core via the film. A liquid passage and an ink ejection openings are formed on this element. Ink droplets are ejected by exerting pressure required to eject the ink using the attraction/returning of the displacing plate associated with the application/elimination of magnetic force carried out by conducting/interrupting current through the electromagnet. Thus, an ink jet head is provided which has excellent ejection stability and power and which achieves dot-based gradation.

26 Claims, 20 Drawing Sheets

STEP 1

STEP 2

STEP 3

STEP 4

STEP 5

STEP 6

STEP 7

STEP 8

STEP 9

STEP 10

STEP 11

STEP 12

STEP 13

STEP 14

STEP 15

STEP 16

STEP 17

STEP 18

STEP 19

STEP 20

INK JET HEAD, MANUFACTURING METHOD THEREOF, AND INK JET PRINTING APPARATUS

This application is based on Patent Application Nos. 2000-366289 and 2000-366290 filed Nov. 30, 2000 in Japan the content of which is incorporated hereinto by reference.

BACKGROUND OF THE INVENTION

1. Field of the Invention

The present invention relates to an on-demand type ink jet head suitable for printing apparatuses such as a printer, a plotter, a copying machine, or a facsimile machine which is used as an image output terminals of printing system, to a method of manufacturing a thin-film coil preferable for the manufacture of the ink jet head, and to a printing apparatus.

2. Description of the Related Art

Proposed on-demand ink jet heads are based on various ink ejection methods.

One of these methods is what is called a thermal ink jet method, which uses thermal energy. With the thermal ink jet method, electricity is conducted through an electrothermal transducer or ejection heater provided inside an ink ejection opening to generate heat to cause a liquid (ink) to bubble. Thus, the pressure of the bubble causes the ink to be ejected through the ejection opening as a small droplet, which then deposit on a printing medium for printing. For example, Japanese Patent Application Laid-open No. 54-59936 (1979) or an operation manual attached to bubble jet printers "BJ-10v" manufactured by Canon Co., Ltd. Contains principle diagrams for this technique and describe in detail the structure of printing apparatuses based on this technique.

Ink jet heads based on another ink jet method employ a piezoelectric member such as a piezoelectric element. With this method, electricity is conducted through the piezoelectric element to deform it, so that generated pressure is provided to ink to eject it as a small droplet. A printing head based on this method is disclosed in Japanese Patent Application Laid-open No. 47-2006 (1972) (inventor: Edmond L. Keiser), and this is, so to speak, the origin of the modern ink jet heads. A recent example of an ink jet head is disclosed in Japanese Patent Application Laid-open No. 5-24189 (1993), and is mounted in ink jet printers "HG5130" or "Stylus800" manufactured by Seiko Epson Co., Ltd. and other printers.

Furthermore, an ink jet head based on another ink ejection method employs an electrostatic drive method and is disclosed in Japanese Patent Application Laid-open No. 6-8449 (1994). Its operation principle is such that a potential is applied to a small space to generate Coulomb's force to displace an electrode, so that the resulting pressure pushes out ink.

On these various methods, the thermal ink jet method employs ink mainly composed of water and containing a coloring material such as a dye and an organic solvent. A temperature of about 300° C., is required to bubble this ink on the ejection heater in a preferable manner, whereas at a high temperature higher than 300° C, the dye is decomposed, and the decomposed pieces may be accumulated on the surface of the ejection heater to cause so called cogation. The cogation may reduce the uniformity of the bubbling to vary the volume or ejection speed of ejected ink. Accordingly, it has been recognized as an obstacle to the improvement of image quality. Further, a cavitation impact, which occurs the moment the bubble disappears, may mechanically damage the surface of the ejection heater to affect the lifetime of the ink jet head. Consequently, a technique of further increasing the lifetime of the ink jet head has been desired.

Furthermore, with the piezoelectric element method, a large piezoelectric element must be used for generating a sufficient pressure to eject a droplet. Thus, it is difficult to densely mount a large number of ejection openings. Moreover, in a process of manufacturing an ink jet head, a machining step is required to produce piezoelectric elements mostly composed of ceramics. However, it is relatively difficult to provide precision machining so as to eject an equal amount of ink through each ejection opening. Furthermore, since the generated pressure is low, if bubbles are generated or mixed in the ink, they may absorb the pressure to make the ejection unstable.

Moreover, an ink jet head based on the electrostatic drive method is constructed more simply than one based on the piezoelectric method, but provides a very weak Coulomb's force, thereby forcing the dimensions of an actuator section to be increased in order to allow ink droplets of a required size to be ejected. It is thus difficult to densely mount a large number of ejection openings. Further, the size of the actuator section restricts the design of ink channels, thereby hindering high-speed printing from being achieved.

Since the various ejection methods have advantages but also have problems to be solved as described above, the inventor examined whether or not any different ejection method could be employed for this purpose. During this process, the inventor designed an ink ejection method of providing a member that is displaced or deformed according to electromagnetic force, and exerting ejection pressure on the ink using the displacement or deformation of the member associated with the application of electromagnetic force and restoration of the member associated with elimination of electromagnetic force.

Then, the inventor found a conventional example of such an ink ejection method using electromagnetic force as disclosed in Japanese Patent Application Publication No. 62-9431 (1987). However, it has recently been desirable to provide high-quality prints at a printing density as high as several hundred to one thousand and several hundred dpi (dots/inch) using several picoliters of ink droplets. To accommodate such a demand, a large number of ejection openings must be densely mounted. However, although the above publication discloses the basic concept of an ink ejection method using electromagnetic force, it provides no specific suggestion for an ink jet head or a manufacture method thereof which meets the above demand.

SUMMARY OF THE INVENTION

It is a main object of the present invention to employ an ejection method using electromagnetic force, while employing a new arrangement for an actuator as an electromagnetic-force-acting portion, to solve the problems with the existing ink jet heads described in the above "Prior Art" section and enable high-definition images to be printed at a high speed so that the images can maintain high quality over time.

In a first aspect of the present invention, there is provided an ink jet head comprising:

an electromagnet portion having a core provided on a substrate and a thin-film coil provided on the substrate so as to surround the core and having at least one turn; and a displacing portion located opposite the electromagnet portion, supported so as to be partially displaceable by magnetic force generated by the electromagnet portion in response to electric conduction, and for causing ink to be ejected in response to pressure resulting from the displacement.

In a second aspect of the present invention, there is provided an ink jet printing apparatus for executing printing on a printing medium using an ink jet head, the apparatus comprising:

means for relatively scanning the ink jet head and the printing medium, and the ink jet head having:

an electromagnet portion having a core provided on a substrate and a thin-film coil provided on the substrate so as to surround the core and having at least one turn; and a displacing portion located opposite the electromagnet portion, supported so as to be partially displaceable by magnetic force generated by the electromagnet portion in response to electric conduction, and for causing ink to be ejected in response to pressure resulting from the displacement.

In a third aspect of the present invention, there is provided a method of manufacturing an ink jet head, the method comprising the steps of:

forming the core on a substrate;

forming a thin-film coil on the substrate so as to surround the core; and disposing a displacing portion opposite the core, the displacing portion being partially displaceable by magnetic force and for causing ink to be ejected in response to pressure resulting from the displacement.

In a fourth aspect of the present invention, there is provided an ink jet head comprising:

an electromagnet portion formed on a substrate; and a displacing portion located opposite the electromagnet portion, supported so as to be partially displaceable by magnetic force generated by the electromagnet portion in response to electric conduction, and for causing ink to be ejected in response to pressure resulting from the displacement, and wherein the electromagnet portion has a core provided on the substrate and a thin-film coil provided on the substrate so as to surround the core, the thin-film coil has a multilayered structure in which a plurality of coil patterns each having at least one turn in substantially the same plane are laminated via insulating layers, and a winding structure in which the coil patterns are sequentially connected through via hole contacts.

In a fifth aspect of the present invention, there is provided an ink jet printing apparatus for executing printing on a printing medium using an ink jet head, the apparatus comprising:

means for relatively scanning the ink jet head and the printing medium, and the ink jet head having:

an electromagnet portion formed on a substrate; and a displacing portion located opposite the electromagnet portion, supported so as to be partially displaceable by magnetic force generated by the electromagnet portion in response to electric conduction, and for causing ink to be ejected in response to pressure resulting from the displacement, and wherein the electromagnet portion has a core provided on the substrate and a thin-film coil provided on the substrate so as to surround the core, the thin-film coil has a multilayered structure in which a plurality of coil patterns each having at least one turn in substantially the same plane are laminated via insulating layers, and a winding structure in which the coil patterns are connected sequentially through via hole contacts.

In a sixth aspect of the present invention, there is provided a method of manufacturing an ink jet head, the method comprising the steps of:

forming the core on a substrate;

forming a thin-film coil by laminating a plurality of coil patterns each having at least one turn in substantially the same plane so as to surround the core are laminated via insulating layers, while sequentially connecting the coil patterns through via hole contacts; and disposing a displacing portion opposite the core, the displacing portion being partially displaceable by magnetic force and for causing ink to be ejected in response to pressure resulting from the displacement.

In a seventh aspect of the present invention, there is provided an thin-film coil having a multilayered structure in which a plurality of coil patterns each having at least one turn in substantially the same plane are laminated via insulating layers, and a winding structure in which the coil patterns are connected sequentially through via hole contacts;

wherein an electrode wiring for connecting the coil with one of the external wirings is provided on the substrate so as to be directly connected to the coil pattern of the lowermost layer facing the substrate, and wherein another electrode wiring for connecting the coil pattern of an uppermost layer that is most distant from the substrate with the other of the external wirings has a multilayered structure in which a plurality of electrode layers are laminated on the substrate via insulating layers, and the electrode layers are electrically connected sequentially through the via hole contacts and connected to the other of the external wirings via the electrode layer of a lowermost layer facing the substrate.

In an eighth aspect of the present invention, there is provided an method of manufacturing a thin-film coil, the method comprising the steps of:

forming a thin-film coil main body by laminating a plurality of coil patterns each having at least one turn in substantially the same plane, while sequentially connecting the coil patterns through via hole contacts;

forming an electrode wiring for connecting the thin-film coil with one of the external wirings on the substrate so as to be directly connected to the coil pattern of a lowermost layer facing the substrate; and forming another electrode wiring for connecting the thin-film coil main body with the other of the external wirings simultaneously with the forming step of the thin-film coil main body, by laminating a plurality of electrode layers on the substrate via insulating layers so as to connect a lowermost electrode layer facing the substrate with the other of the external wirings and to connect an uppermost electrode layer with connect the coil pattern of an uppermost layer, while sequentially connecting electrode layers through via hole contacts.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described below in detail with reference to the drawings.

First, since the various ejection methods discussed in the prior art section have advantages but also have problems to be solved, the inventor examined whether or not any different ejection method could be employed for this purpose. During this process, the inventor designed an ink ejection method of forming a thin-film coil on a substrate, providing a member that is displaced or deformed according to electromagnetic force generated by electricity conducted through the thin-film coil, and exerting ejection pressure on the ink using the displacement or deformation of the member associated with the application of electromagnetic force and restoration of the member associated with elimination of electromagnetic force.

Embodiments using such a method will be described in the following order:

1. Embodiment Using a Planar Coil
   - (1.1) Construction of an Essential Part of an Ink Jet Head and an Ejecting Operation Performed thereby
   - (1.2) Component Materials and Manufacture Process
   - (1.3) Ink jet Head and Printing Apparatus
   - (1.4) Another Embodiment of a Construction of the Essential Part of the Ink Jet Head
   - (1.5) Evaluation of Operations
2. Embodiment Using a Stereostructure Coil
   - (2.1) Prerequisites
   - (2.2) Construction of an Essential Part of an Ink Jet Head and an Ejecting Operation Performed thereby
   - (2.3) Component Materials and Manufacture Process
   - (2.4) Evaluation of Operations
   - (2.5) Another Embodiment of a Construction of the Essential Part of the Ink Jet Head
3. Other Embodiments

1. Embodiment Using a Planar Coil

Figure 1:
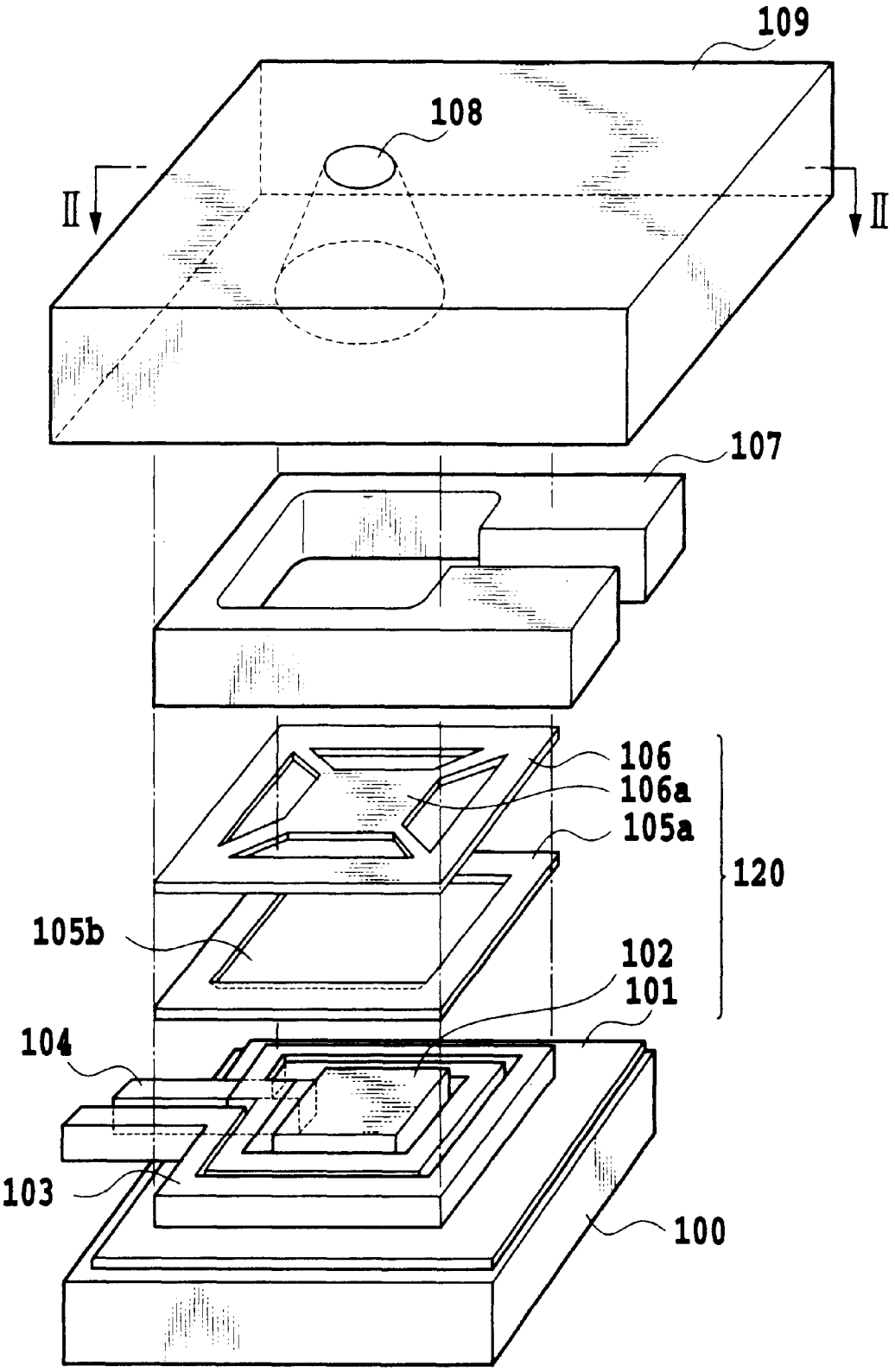
FIG. 1 is a schematic perspective view showing an embodiment of a basic construction of an actuator and an ink channel portion which constitute an essential part of an ink jet head according to an embodiment using a thin-film coil formed like a plane.

(1.1) Construction of an Essential Part of an Ink Jet Head and an Ejecting Operation Performed thereby FIG. 1 shows an embodiment of a basic construction of an actuator and an ink channel portion which constitute an essential part of an ink jet head according to an embodiment using a thin-film coil formed like a plane.

The actuator 120 in this embodiment comprises an electromagnet portion having an insulating film 101 formed on a substrate 100, an electromagnetic core 102, a spiral thin-film coil 103 having, for example, "two" turns, and electrode wiring 104, a film 105*a* for isolating the electromagnet portion from ink, and a displacing plate 106 composed of a magnetic material that can be displaced or deformed within a recess 105*b* formed in the film 105*a* (that is, the displacing plate 105 formed so as to be at least partially deformed (a portion 106*a*) in response to the application of magnetic force). Then, a liquid passage wall forming member 107 and an orifice plate 109 having an ejection opening 108 formed therein are arranged over the actuator 120 to form the essential part of the ink jet head.

Figure 2:
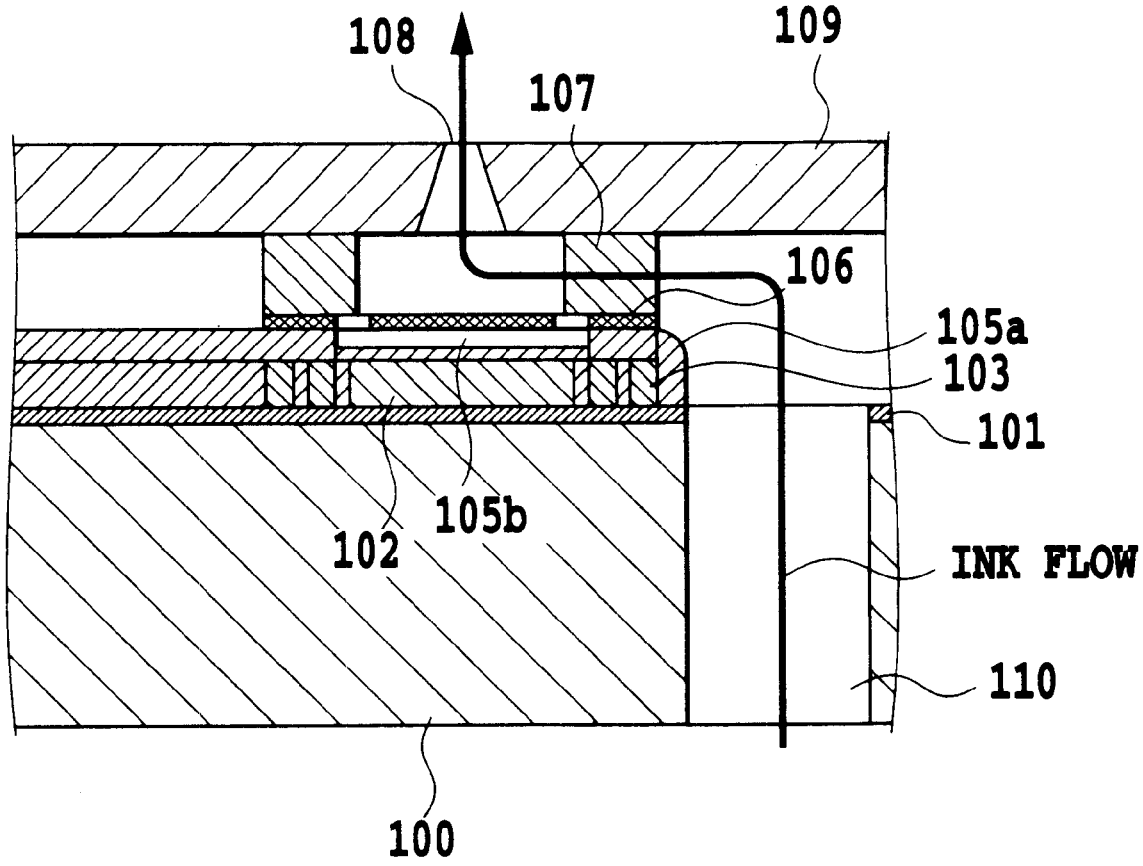
FIG. 2 is a sectional view taken along line II–II' in FIG. 1.

FIG. 2 is a sectional view taken along line II–II' in FIG. 1. It is assumed that ink is introduced into the liquid passage wall forming member 107 by flowing in the direction shown by the thick arrow in the figure. Further, between the recess 105*b* in the isolating film 105*a* and the displacing plate 106 is formed a void having a height equal to or larger than a distance within which the displacing plate 106 can be displaced or deformed. Reference numeral 110 denotes an ink supply passage for supplying ink to the ink jet head. In this embodiment, the ink supply passage is formed by directly punching a silicon substrate by a sand blast process, an ICP (Inductively Coupled Plasma) process, an anisotropic etching process, or the like.

The ejecting operation of the ink jet head according to this embodiment will be described with reference to FIG. 3.

Figure 3A:
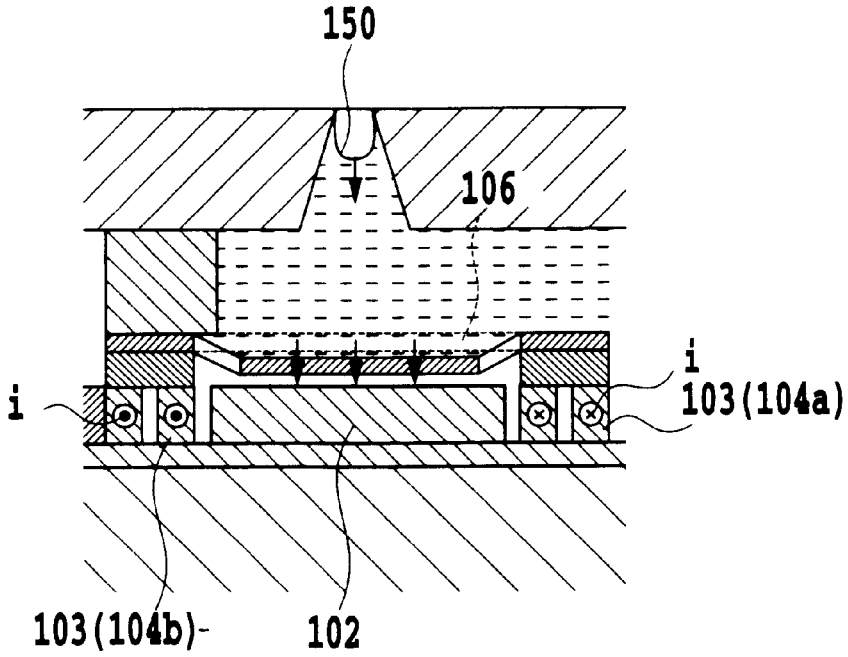
FIGS. 3A and 3B are views useful in describing an ejecting operation performed by an ink jet head having the essential part constructed as shown in FIGS. 1 and 2.
Figure 3B:
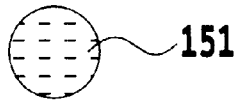
Figure 3B:
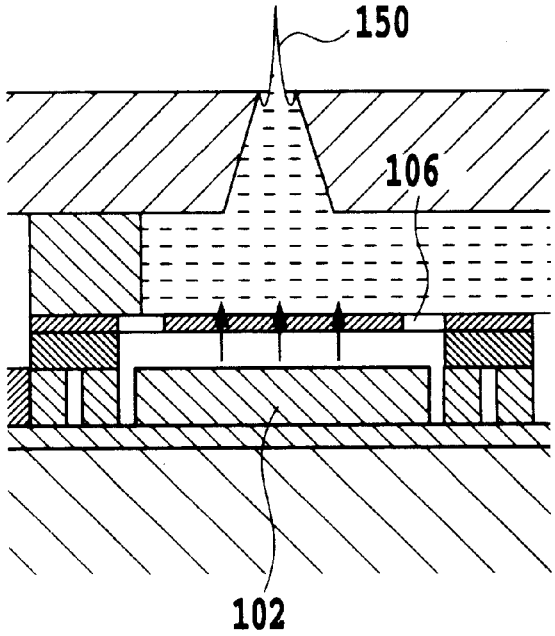

When electricity is conducted through the coil 103 of the actuator 120 via one side 104*a* of the electric wiring, a current i flows from the symbol "x" to the symbol "○" in the coil main body 103, that is, to the other side of the electrode wiring 104*b*, as shown in FIG. 3A. Magnetic force is correspondingly generated in the axial direction of the core 102 to deform the displacing plate 106 in the direction shown by the arrows in FIG. 3A (toward the core). At this time, the ink in the liquid passage responds to the deformation of the deformed plate 106 to pull meniscus 150 to the interior of the ejection opening.

When the current is interrupted, the displacing plate 106 moves back to its original position owing to its own elasticity. At this time, the displacing plate 106 exerts pressure on the ink in the direction shown by the arrows in FIG. 3 to apply kinetic energy to the ink, thereby generating an ink droplet 151, which is separated from the meniscus 150 and fly off through the ejection opening. The ink droplet 151 lands on a printing medium such as paper, a plastic film, a cloth, or the like to form a dot thereon.

By conducting a current of a pulse waveform through the coil 103 and repeatedly providing this current, continuous ejection is enabled. Further, by varying the power of the provided pulse (pulse width and/or current value), the displacement or deformation of the displacing plate 106 can be varied. Consequently, differently-sized droplets can be ejected through the ejection opening, thereby enabling the size of dots varied during printing.

(1.2) Component Materials and Manufacture Process

Now, preferred materials used to form the components of the ink jet head of this embodiment will be listed below.

The substrate 100 is most preferably composed of monocrystal silicon. This material enables wiring required to drive the ink jet head and drive elements such as transistors to be integrated together using a manufacture process similar to that for semiconductors. The insulating film 101 can be produced by thermally oxidizing the surface of the silicon substrate 100 or by a thin-film forming method such as a sputtering or CVD process.

The core 102 of the electromagnet portion may be composed of a ferromagnetic material with a high permeability. Preferred materials include Ni—Fe (permalloy), Fe, Co, Ni, and ferrite. To form the core 102 on the substrate 100, an electrodeposition or sputtering process can be used after a high-conductivity thin film of Au is formed in a lower layer of the core material.

The coil 103 and the electrode wiring 104 are composed of a conductive material such as Cu, Au, or Al. Of these materials, Al is preferred in order to allow the coil 103 and the electrode wiring 104 to formed in the same step in which the drive elements such as transistors are formed on the substrate. Further, the coil 103 and the electrode wiring 104 preferably have a film thickness of about 0.5 to 1 $\mu$m. It is typically preferable that the coil be spirally formed, and the number of turns may be determined on the basis of a magnetic flux density preferred for a desired amount of ink ejection.

If a conductive liquid such as aqueous ink is ejected, the isolating film 105 is preferably an insulating thin film made of $SiO^2$, SiN, or the like in order to protect the core 102 and the coil 103 from conduction corrosion. However, if a non-conductive liquid such as ink mainly composed an organic solvent is ejected, no practical problems occur even without the isolating film 105. The isolating film can be formed using the thin-film forming process such as the sputtering or CVD process.

Since the displacing plate 106 is displaced or deformed (vibrated) perpendicularly to the surface thereof, it is preferably composed of a magnetic material having a high permeability. Like the core material, the material of the displacing plate 106 preferably includes Ne—Fe (permalloy), Fe, Co, Ni, and ferrite. If a conductive liquid such as aqueous ink is used, a sandwich structure comprising a magnetic material layer sandwiched between insulating materials such as $SiO_2$ is effective in preventing corrosion resulting from contact with ink.

The liquid passage wall forming member 107 is preferably composed of a photosensitive resin film, with which the desired liquid passage can be formed by the photolithography method.

The orifice plate 109 is composed of a resin such as polyimide or metal such as Ni. With the resin, the ejection opening 108 can be formed by, for example, laser beam machining. With the metal, the plate may be formed by an electroforming process after, for example, a resist-based mask pattern used to form the ejection opening has been formed.

A method of manufacturing an ink jet head according to this embodiment will be described with reference to FIGS. 4A to 4E, 5A to 5E, 6A to 6E, and 7A to 7E. The manufacture method of this embodiment is based on a micromachining process comprising a combination of the formation and patterning of thin film.

Figure 4A:
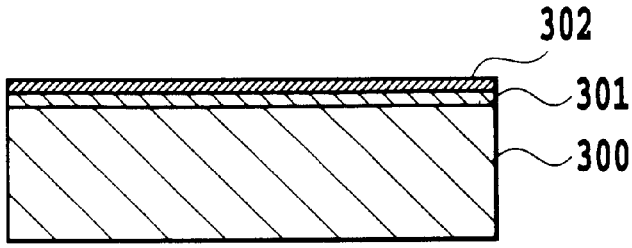
FIGS. 4A to 4E, 5A to 5E, 6A to 6E, and 7A to 7E are views useful in describing a process of manufacturing the essential part of the ink jet head shown in FIGS. 1 and 2.

Step 1: FIG. 4A

An $SiO_2$ layer 301 that is to be formed into the insulating film 101 is formed, by the sputtering process, on a surface of a silicon substrate 300 so as to have a thickness of 1 $\mu$m, the silicon substrate 300 being to be formed into the substrate 100. Next, an Au film 302 that is to be formed into the lower layer of the core material is formed by evaporation so as to have a thickness of 0.1 $\mu$m.

Figure 4B:
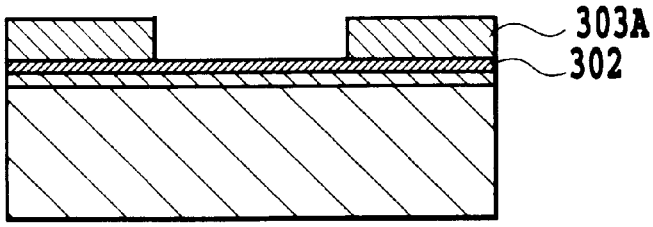

Step 2: FIG. 4B

A photoresist 303A is applied thereto, and an opening used to arrange the core is patterned by the photolithography process.

Figure 4C:
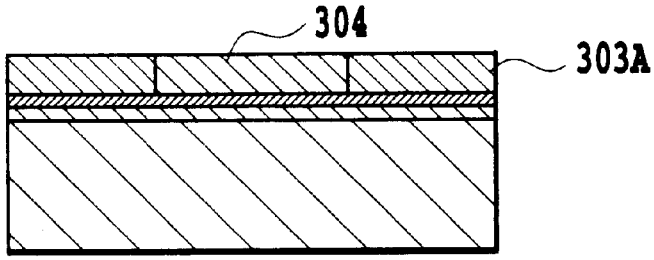

Step 3: FIG. 4C

A layer 304 of a core material (Ni—Fe) used to form the core 102 is formed so as to have a thickness of 5 $\mu$m by electrodeposition using an Au film 302 as an electrode.

Figure 4D:
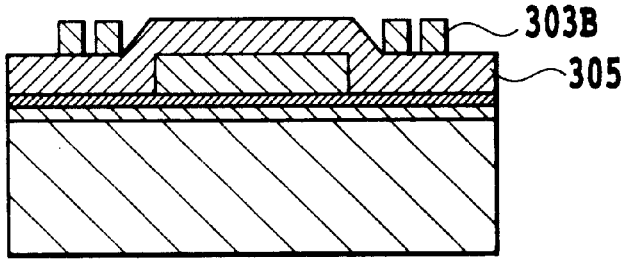

Step 4: FIG. 4D

An Al film 305 that is to be formed into the coil 103 and the electrode wiring 104 is sputtered so as to have a thickness of 1 $\mu$m. A phororesist 303B is applied thereto and then patterned into configurations of the coil 103 and the electrode wiring 104.

Figure 4E:
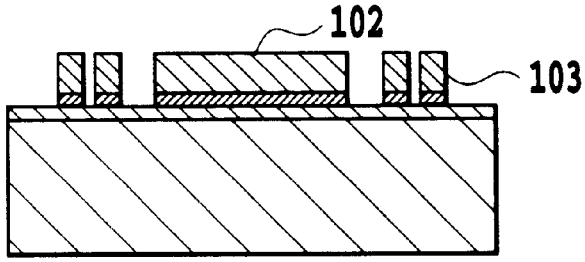

Step 5: FIG. 4E

The Al film 305 is removed by a well-known wet or dry etching process while leaving a predetermined pattern including the photoresist 303B. Next, any unnecessary portion of the Au film 302 is removed.

Figure 5A:
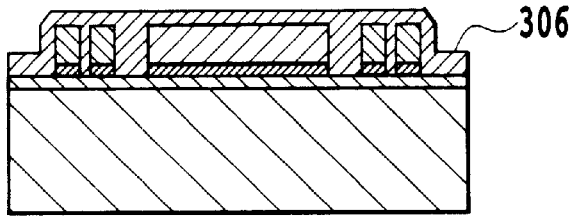

Step 6: FIG. 5A

An $SiO_2$ film 306 that is formed into the isolating film 105 is formed by, for example, sputtering so as to have a thickness of 3 $\mu$m.

Figure 5B:
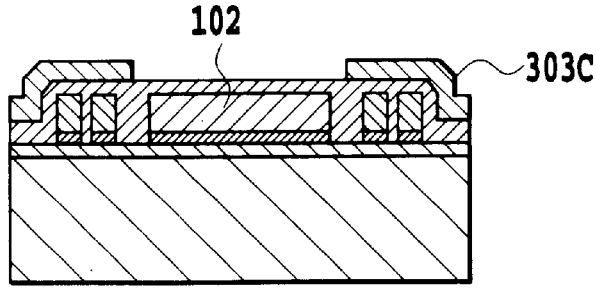

Step 7: FIG. 5B

A photoresist 303C is applied thereto and then patterned so as to coat the electromagnet portion except for a location over the core 102.

Figure 5C:
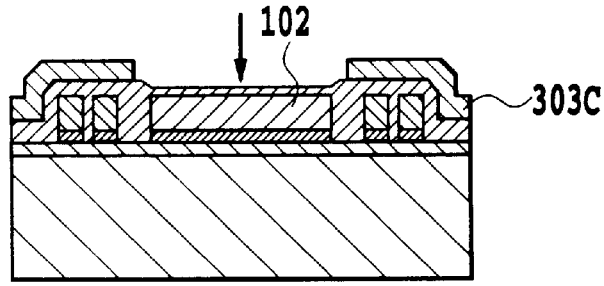

Step 8: FIG. 5C

A portion of the $SiO_2$ film 306 located on the core 102 and shown by the arrow in the figure is thinned by the dry etching process or the like.

Figure 5D:
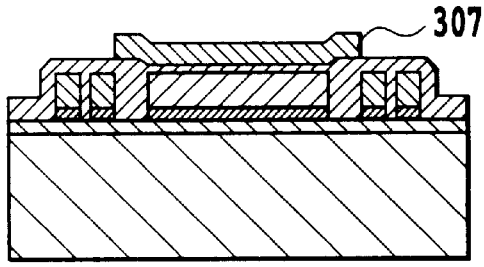

Step 9: FIG. 5D

The Al film 307 is formed so as to have a thickness of 3 $\mu$m with the photoresist 303 remaining. Then, the photoresist 303C is removed.

Figure 5E:
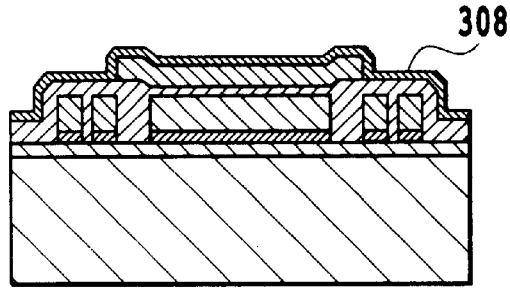

Step 10: FIG. 5E

An $SiO_2$ film 308 is formed so as to have a thickness of 1 $\mu$m; it is to be formed into a lower layer that cooperates with an upper layer in sandwiching a magnetic substance that is to be formed into the main body of the displacing plate 106.

Figure 6A:
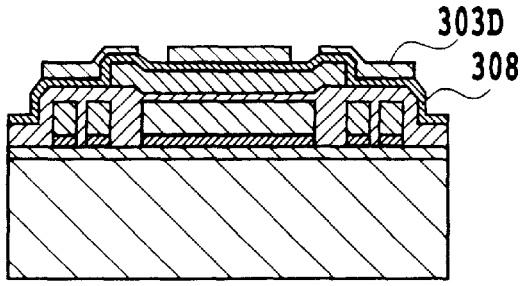

Step 11: FIG. 6A

A photoresist 303D is applied thereto and then patterned into the shape of the displacing plate 106.

Figure 6B:
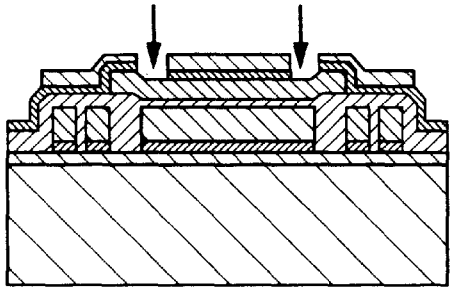

Step 12: FIG. 6B

Portions of the $SiO_2$ film 308 which are shown by the arrows in the figure are removed by the dry etching. Then, the photoresist 303D is removed.

Figure 6C:
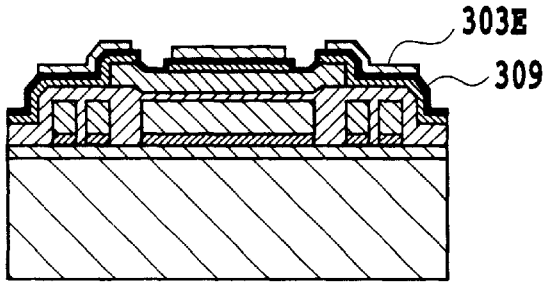

Step 13: FIG. 6C

An Ni—Fe film 309 that is to be formed into the main body of the displacing plate 106 is formed by sputtering or the like so as to have a thickness of 1 $\mu$m. Then, a photoresist 303E is applied thereto and then patterned so as to expose portions of the Ni—Fe film 309 which are shown by the arrows in FIG. 6B.

Figure 6D:
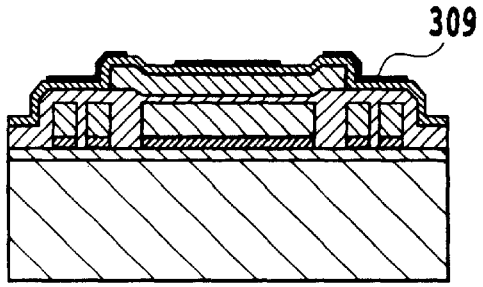

Step 14: FIG. 6D

The Ni—Fe film is patterned into the shape of the displacing plate 106 by the well-known wet or dry etching process, and then the photoresist 303E is removed.

Figure 6E:
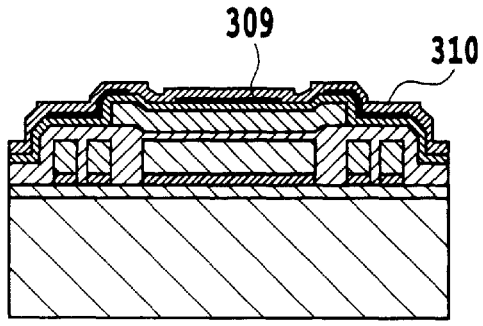

Step 15: FIG. 6E

An $SiO_2$ film 310 is formed so as to have a thickness of 1 $\mu$m; it is to be formed into an upper layer that cooperates with the lower layer in sandwiching the magnetic substance that is to be formed into the main body of the displacing plate 106.

Figure 7A:
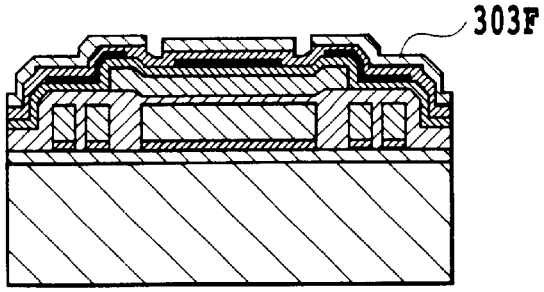

Step 16: FIG. 7A

A photoresist 303F is applied thereto and patterned into the shape of the displacing plate 106.

Figure 7B:
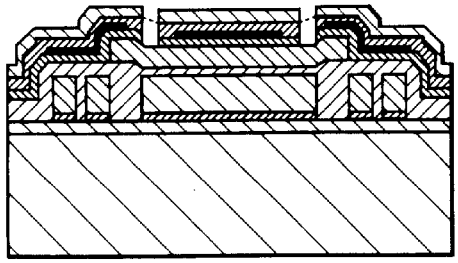

Step 17: FIG. 7B

Portions of the $SiO_2$ film which are located at the openings in the displacing plate 106 are removed by dry etching.

Figure 7C:
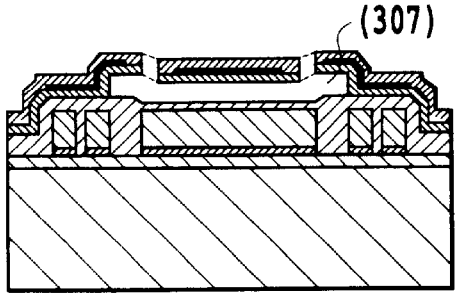

Step 18: FIG. 7C

The Al film 307, underlying the displacing plate 106, is removed by wet etching using the openings in the displacing plate 106.

Figure 7D:
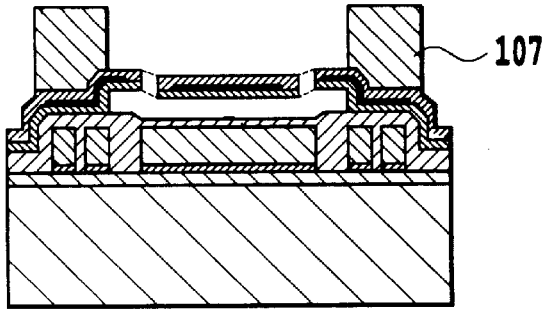

Step 19: FIG. 7D

A photosensitive dry film of 30 $\mu$m thickness is stuck thereto, and the predetermined liquid passage forming member 107 is formed by photolithography.

Figure 7E:
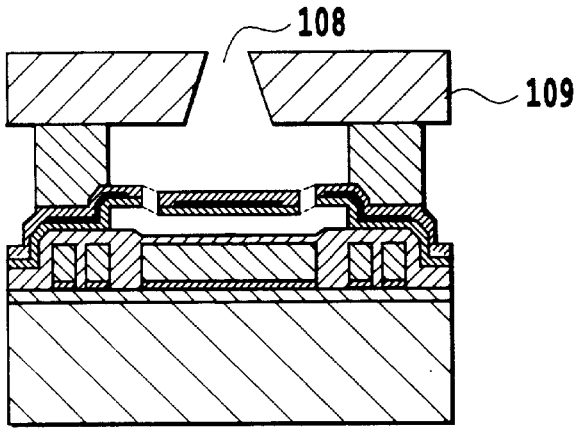

Step 20: FIG. 7E

A polyimide film of 50m thickness having the ejection opening 108 formed therein by laser beam machining as the orifice plate 109 is positioned on and stuck to the liquid passage wall forming member 107, thereby completing the structure of an essential part of an ink jet head.

The location at which portions of the coil pattern cross each other, for example, the location at which the coil pattern crosses a portion thereof extending to the side 104*b* of the electrode wire which constitutes a current return side can be formed as follows: For example, this coil pattern portion is formed as a lower layer of the coil, and an insulating layer is formed thereon. Furthermore, predetermined via holes are formed in the insulating layer, and then a main pattern of the coil is formed. Alternatively, the main pattern of the coil is formed except for this coil pattern portion, and an insulating layer is formed thereon. Furthermore, predetermined via holes are formed in the insulating layer, and then the coil pattern portion is formed.

(1.3) Ink Jet Head and Printing Apparatus

Figure 8:
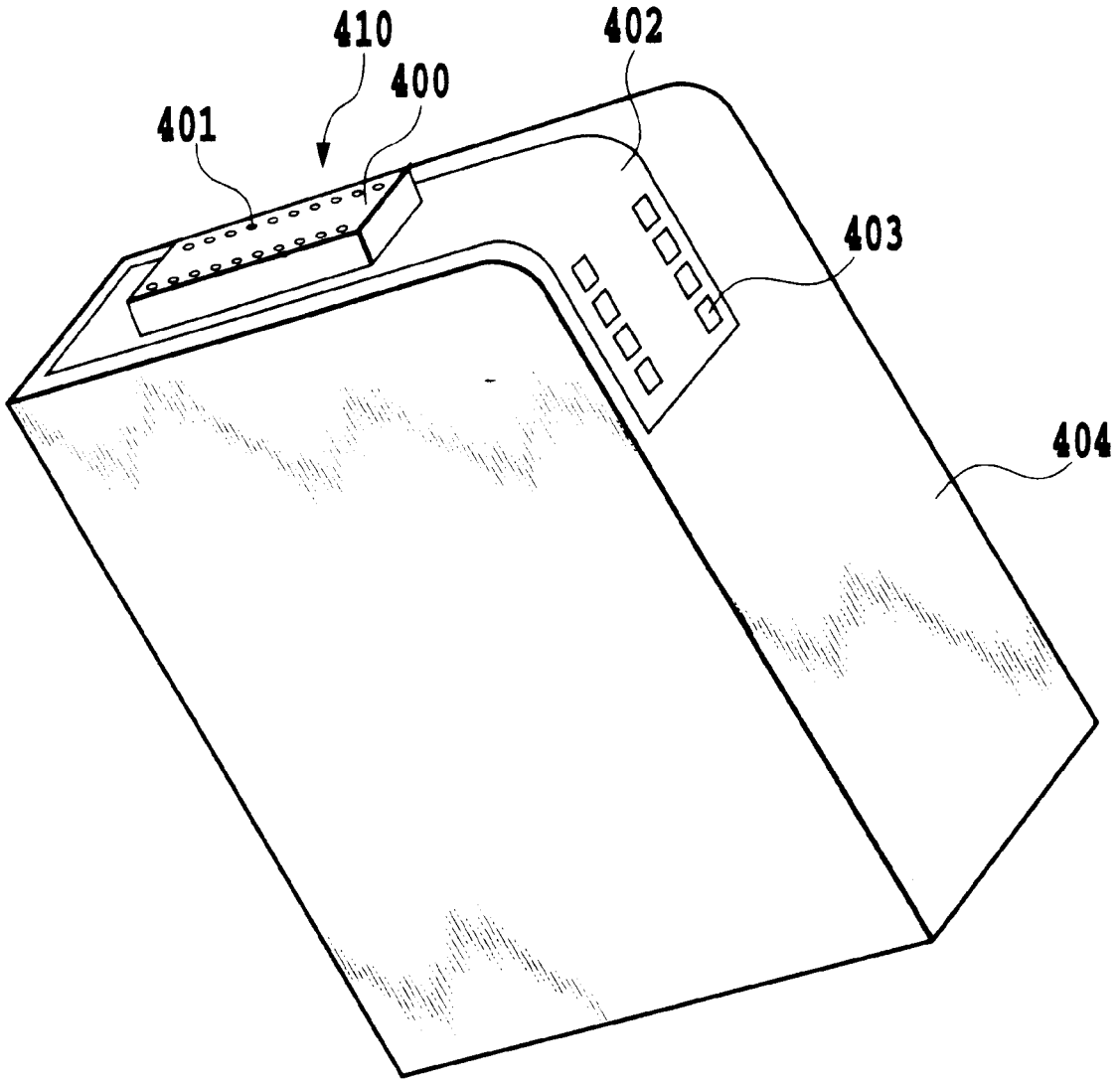
FIG. 8 is a perspective view showing an embodiment of a construction of an ink jet head unit including the essential part shown in FIGS. 1 and 2, as an component thereof.

FIG. 8 is a perspective view showing an embodiment of a construction of an ink jet heat unit including the above-described actuator 120 as a component. This head unit comprises an ink jet head portion 410 having the substrate (300) on which a plurality of actuators 120 are formed on during the same step and the liquid passage wall forming section and an integral orifice plate 400 arranged therein. The head portion 410 in the illustrated example has two columns of ejection openings 401 arranged on the orifice plate 400 at a pitch of 150 dpi (dots/inch) within each column. The two columns each having 10 ejection openings are staggered or shifted by a predetermined amount (for example, half the above pitch) each other in the arranging direction and therefore a total of 20 ejection openings are used to achieve a 300 dpi resolution. The actuators are also formed on the substrate so as to correspond to the above arrangement.

In FIG. 8, reference numeral 402 denotes a tape member for TAB (Tape Automated Bonding) having a terminal for supplying power to the head portion 410. The tape member 402 supplies power from the printer main body via contacts 403. Reference numeral 404 denotes an ink tank for supplying ink to the head portion 410 and which is in communication with the ink supply passage 110, shown in FIG. 2. That is, the ink jet head unit in FIG. 8 has the form of a cartridge that can be installed in the printing apparatus.

Figure 9:
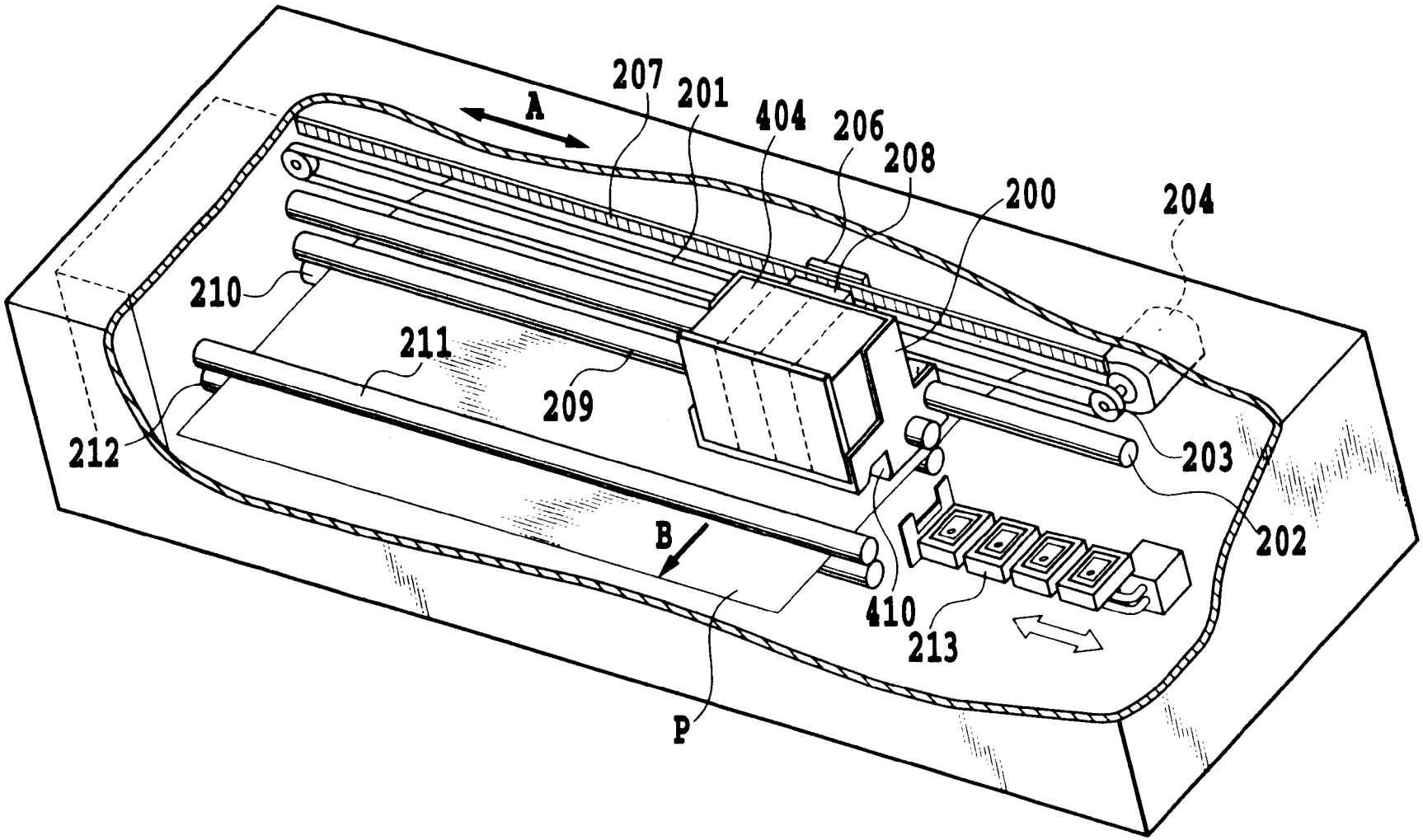
FIG. 9 is a perspective view showing an embodiment of a construction of an ink jet printing apparatus that performs a printing operation using the ink jet head unit shown in FIG. 8.

FIG. 9 schematically shows an embodiment of a construction of an ink jet printing apparatus that performs a printing operation using the ink jet head unit shown in FIG. 8.

In the illustrated ink jet printing apparatus, a carriage 200 is fixed to an endless belt 201 and is movable along a guide shaft 202. The endless belt 201 is wound round pulleys 203 and 204. The pulley 203 is connected drive shaft of a carriage driving motor 204. Accordingly, the carriage 200 performs a main-scanning operation by moving back and forth along the guide shaft 202 in response to rotational driving by the motor 204.

On the carriage 200, mounted is an ink jet head unit in the form of a cartridge comprising the ink tank 404 and the head portion 410 having the plurality of ink ejection openings arranged therein as described above. The ink jet head unit is mounted on the carriage 200 such that the ejection openings 401 in the head portion 401 are opposite a printing sheet P as a printing medium and the above arranging direction coincides with a direction different from the main-scanning direction (for example, a sub-scanning direction, in which the printing sheet P is transported). A desired number of pairs of the ink jet 410 and the ink tank 404 can be provided correspondingly to ink colors used. In the illustrated example, four pairs are provided correspondingly to four colors (for example, black, yellow, magenta, and cyan).

Further, the illustrated apparatus is provided with a linear encoder 206 for purposes such as the detection of position of the carriage in the main-scanning direction. One of the components of the linear encoder 206 is a linear scale 207 provided along the movement direction of the carriage 200 and having slits formed therein at equal intervals so as to have a predetermined density. On the other hand, the carriage 200 is provided with the other component of the linear encoder 206, for example, a slit detecting system 208 having a light emitting section and a light receiving sensor, and a signal processing circuit. Accordingly, the linear encoder 206 outputs an ejection timing signal for defining ink ejection timings and carriage position information as the carriage 200 moves.

The printing sheet P as the printing medium is intermittently transported in the direction shown by an arrow B and which is orthogonal to the main-scan direction of the carriage 200. The printing sheet P is supported by an upper stream-side pair of roller units 209 and 210 in the transporting direction and a downstream-side pair of roller units 211 and 212 and transported while maintaining flat relative to the ink jet head 410 owing to an applied tension. Drive force is transmitted to each roller unit by a sheet transporting motor (not shown).

With this construction, an printing operation on the entire printing sheet P is performed by alternately repeating a printing over a width corresponding to the arranged width of the ejection openings in the ink jet head 410 as the carriage 200 moves and the transportation of the printing sheet P.

The carriage 200 is stopped at its home position at the start of printing and as required during printing. A capping member 213 is provided at the home position to cap the surface (ejection opening forming surface) of the ink jet head 410 in which the ejection openings are formed. The capping member 213 has a suction recovery means (not shown) connected thereto to forcibly suck ink through the ejection openings in order to prevent the blockage of the ejection openings or the like.

(1.4) Another Example of a Construction of the Essential Part of the Ink Jet Head Now, another embodiment of a construction of the essential part of the ink jet head will be discussed. In the construction in FIG. 1, the direction in which the ink is ejected is substantially equal to the direction in which the displacing plate 106 is displaced (that is, the direction substantially perpendicular to the main plane of the displacing plate 106). In contrast, in this embodiment, the ink ejection direction is substantially orthogonal to the displacement direction of the displacing plate 106 (that is, the direction substantially parallel with the main plane of the displacing plate 106).

Figure 10:
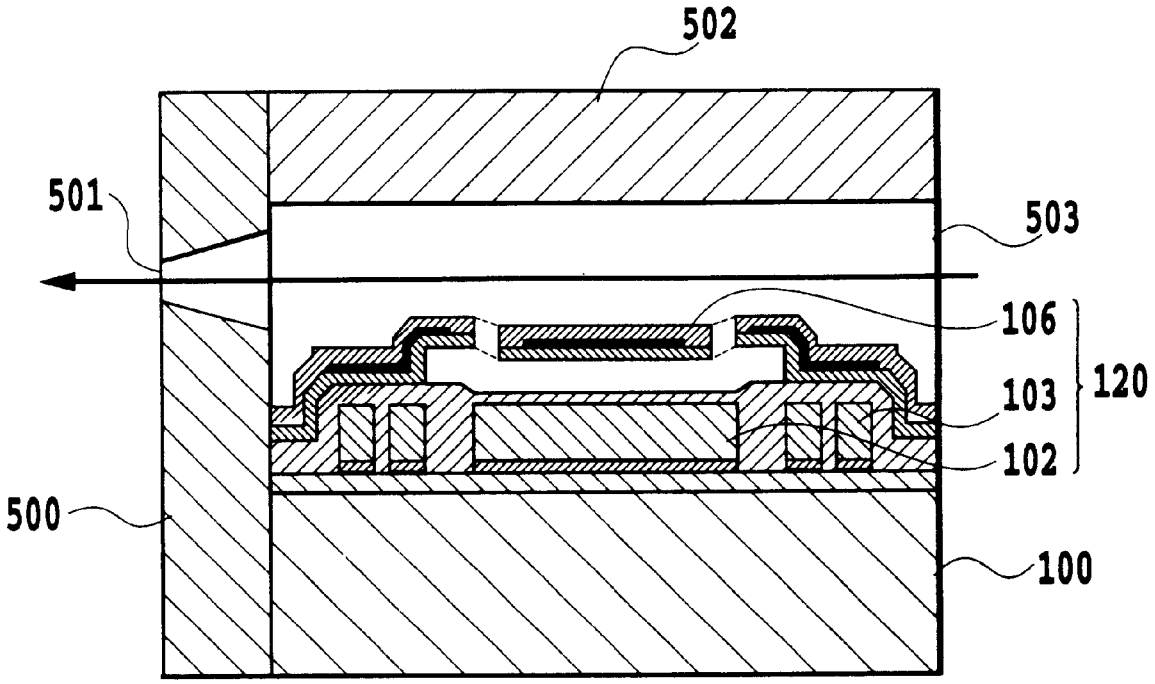
FIG. 10 is a sectional view showing another embodiment of an ink jet head constructed by applying the essential part shown in FIG. 1 thereto.

FIG. 10 is a sectional view taken along the ink channel and which is useful in describing the embodiment of the construction of the ink jet head. In this figure, reference numeral 500 denotes an orifice plate having ejection openings 501 formed by laser beam machining or the like as described above and which is joined perpendicularly to the substrate 100 having the actuator 120 formed thereon.

The actuator 120 in FIG. 10 is constructed as in the case with the above embodiment. Reference numerals 502 and 503 denote wall members forming a liquid passage. The wall members 502 and 503 constitute a liquid passage ceiling portion and a liquid passage side wall, respectively, and can each be formed of a resin such as polyimide or polysulfone.

According to this construction, the ink flows substantially in the direction shown by the thick arrow in the figure, so that ink droplets are ejected through the ejection openings 501 substantially parallel with the main plane of the displacing plate 106. Further, the amount of ink ejected from the ink jet head in this embodiment can be adjusted to a predetermined value depending on the distance from the center of the main plane of the displacing plate 106, constituting the actuator 120, to the tip of the ejection opening, the size of the displacing plate 106, the size of the electromagnet portion, and the like.

(1.5) Evaluation of Operations

An explanation will be given of the results obtained by actually operating an ink jet head having the essential part construction described above.

Figure 11A:
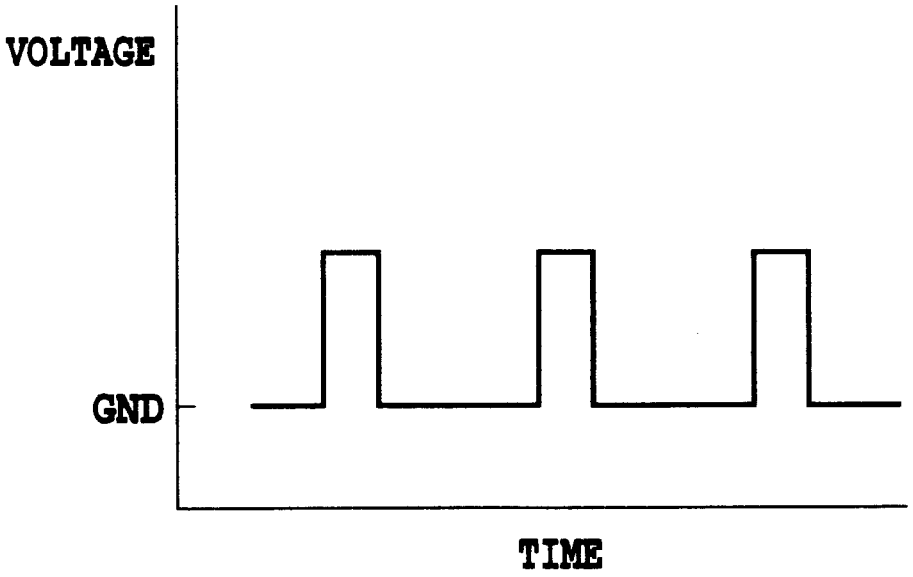
FIGS. 11A and 11B are waveform diagrams showing drive signals provided to ink jet heads according to embodiments of the present invention in order to evaluate its operation.

A head portion having an essential part such as the one constructed as shown in FIG. 2 and having the actuators and the ejection openings arranged at a pitch of 150 dpi each column as shown in FIG. 8 is supplied with aqueous ink composed of 70% of water, 25% of ethylene glycol, and the remaining 5% of dye and having a viscosity of 2.5 mPa·s. Then, the current pulse shown in FIG. 11A are applied to the ink jet head at a period of 50 Hz, and the state of ejection is observed.

Figure 11B:
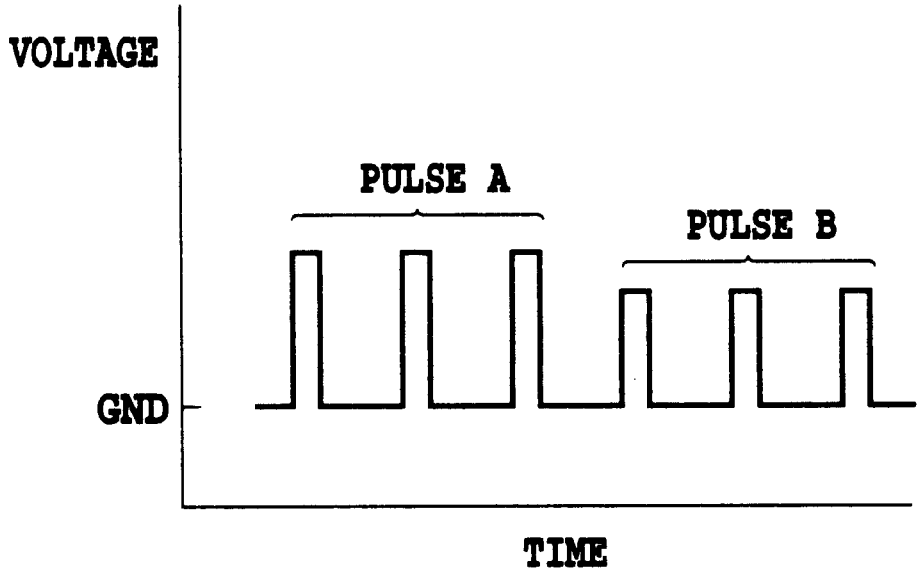

When the ink was continuously ejected, the size of ejected droplets was constant and no variation in the ejection speed was observed. Furthermore, when the current pulses shown in FIG. 11B was used to drive the ink jet head, the "pulse A" enabled large droplets to be stably ejected, while the "pulse B" enabled small droplets to be stably ejected, indicating the possibility of dot-based gradation.

Next, a head portion having an essential part such as the one constructed as shown in FIG. 10 is supplied with the above-described aqueous ink. Then, the current pulse shown in FIG. 11A was applied to the ink jet head at a period of 50 Hz, and the state of ejection was observed.

When the ink was continuously ejected, the size of ejected droplets was constant and no variation in the ejection speed was observed. Furthermore, when the current pulses shown in FIG. 11B was used to drive the ink jet head, the "pulse A" enabled large droplets to be stably ejected, while the "pulse B" enabled small droplets to be stably ejected, indicating the possibility of gradation based on dots.

Furthermore, these two types of ink jet heads were supplied with ink composed of 70% of water, 25% of glycerin, and the remaining 5% of dye and having a viscosity of 4.5 mPa·s. Then, when current pulses similar to those described above were used to drive these ink jet heads, stable continuous ejection was achieved as in the case with the first ink.

Since the above-described embodiment uses electromagnetic force to eject the ink, ejection stability and ejection power can be substantially improved compared to the conventional ink jet methods. Further, since the essential part of the head can be produced by micromachining processing, the actuators and the ejection openings are densely mounted easily.

2. Embodiment Using a Stereostructure Coil (2.1) Prerequisites

In the above-described embodiment, the actuator coil is formed on the substrate substantially like a plane and can achieve a very excellent ejection stability as is apparent from the evaluation of operations. In the above-described construction, the number of turns in the coil is "two" as shown in FIG. 1, it may be varied depending on the desired amount of ink ejected and the range of variations in the amount. That is, the coil may have only one turn or three or more turns.

When the number of turns is defined as n, the permeability of the core material is defined as $\mu_0$, current is defined as I, and the density of generated magnetic fluxes is defined as B, the following relationship is generally established:

$$B=\mu_0 nI$$

Accordingly, it is typically preferable that the coil be formed like a spiral and that the number of turns be increased in order to obtain higher ejection power and allow the amount of ink ejected to be varied over a wider range. It should be appreciated that a coil with a large number of turns can be formed on the substrate substantially like a plane, using the above-described steps.

However, for a higher print speed and definition, which has particularly been desired in recent years, it is highly desirable that a large number of ejection openings be densely mounted. To achieve this, the size of the actuator is desirably reduced. On the other hand, in the planar coil construction, the area on the substrate which is occupied by the actuator coil increases consistently with the number of turns.

Thus, the inventor designed a method of forming a stereostructure or three-dimensional coil on the substrate. Then, the inventor focused attention on the technique disclosed in Japanese Patent Application Laid-open No. 5-55043 (1993). This discloses a method of manufacturing a multilayered turn type small coil in which a one-turn coil in one plane is connected to a one-turn coil in another plane through a via hole.

By basically applying such a technique to the method of manufacturing an ink jet head as designed by the inventor, it is expected that the size of an ink jet head using electromagnetic force can be reduced and that a large number of ejection openings to be more densely mounted.

However, in the method of manufacturing a thin-film coil as disclosed in Japanese Patent Application Laid-open No. 5-55043 (1993), in order that the uppermost one-turn coil may draw out and connect to external wiring, a wiring must be formed at the side of the coil main body. The inventor found that it is difficult to form sufficiently conductive wiring by the typical thin-film forming process, in case that the number of turns of the coil is increased and the coil becomes higher.

An embodiment will be described below which uses an actuator having a three-dimensional thin-film coil formed on the substrate and having a multilayered structure to reduce the size of an ink jet head using electromagnetic force, while increasing the density of a large number of ejection openings. This method thus provides a connection structure that can be reliably used even if the number of turns in the thin-film coil is increased.

Figure 12:
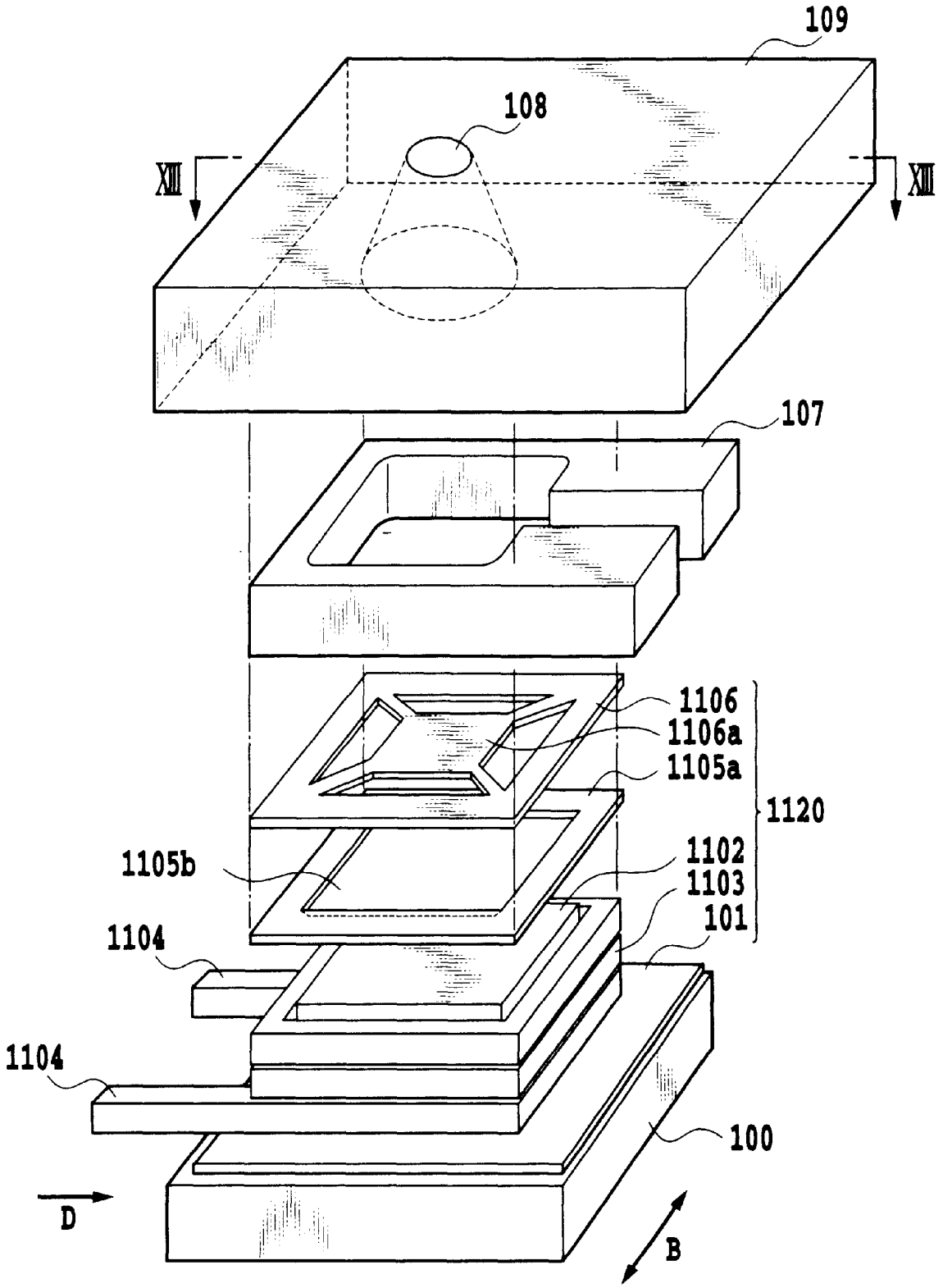
FIG. 12 is a schematic perspective view showing an embodiment of a basic construction of an actuator and an ink channel portion which constitute an essential part of an ink jet head according to an embodiment using a three-dimensionally formed coil.

(2.2) Construction of an Essential Part of an Ink Jet Head and an Ejecting Operation Performed thereby FIG. 12 shows an embodiment of a basic construction of an actuator and an liquid passage portion which constitute an essential part of an ink jet head according to an embodiment using a coil formed in three dimensionally. Those components which can be constructed similarly to the corresponding ones in FIG. 1 are denoted by the same reference numerals.

The actuator 1120 in this embodiment is composed of an electromagnet portion having an insulating film 101 formed on a substrate 100, which is similar to the one in FIG. 1, an electromagnetic core 1102 sized correspondingly to the length of the coil in the axial direction, a three-dimensional spiral thin-film coil 1103 having a multilayered structure and electrode wirings 1104, a film 1105*a* for isolating the electromagnet portion from ink, and a displacing plate 1106 having a magnetic material that can be displaced or deformed within a recess 1105*b* formed in the film 105*a* so as to have an appropriate depth (that is, the displacing plate 105 formed so as to be at least partially deformed (a portion 106*a*) in response to the application of magnetic force). Then, a liquid passage wall forming member 107 and an orifice plate 109 having a ejection opening 108 formed therein are arranged over the actuator 120 to form the essential part of the ink jet head of this embodiment, as in the case with the construction in FIG. 1.

Figure 13:
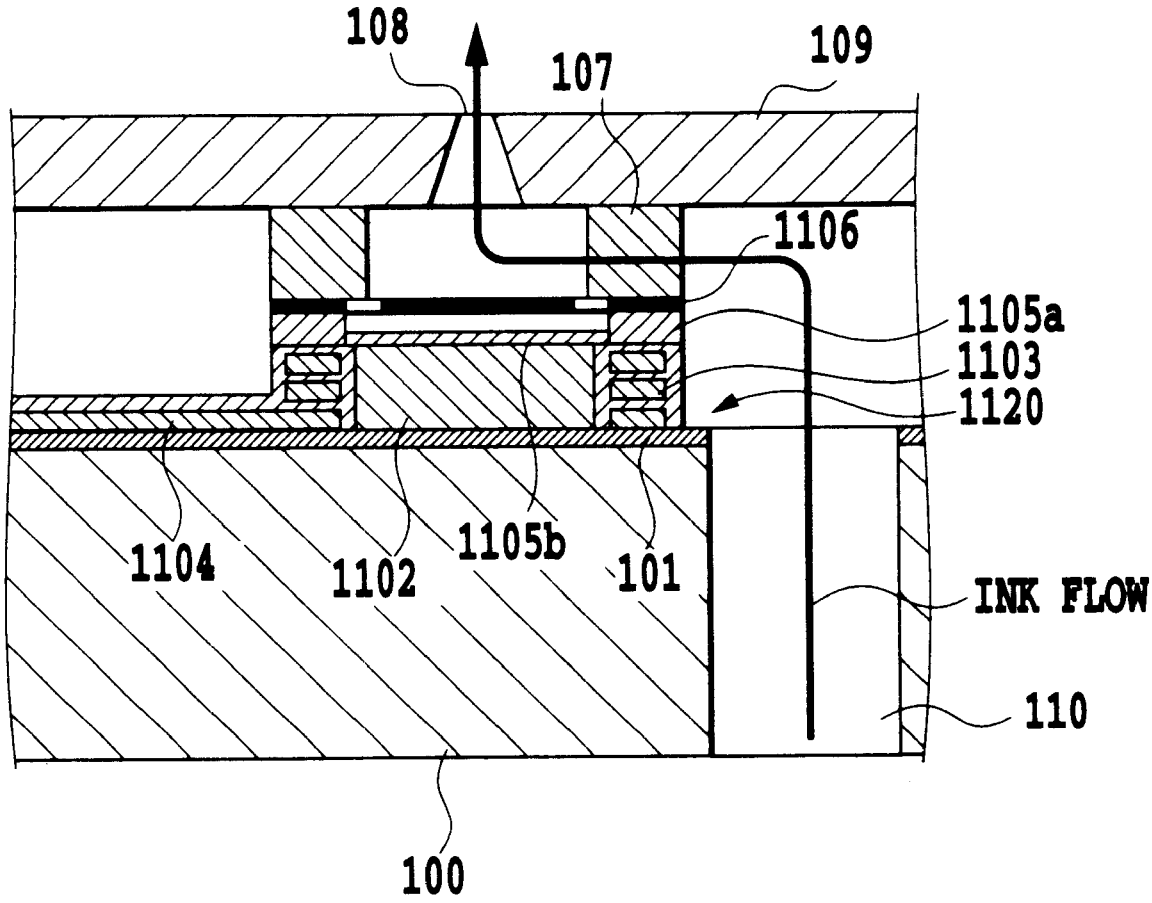
FIG. 13 is a sectional view taken along line XIII–XIII' in FIG. 12.

FIG. 13 is a sectional view taken along line XIII–XIII' in FIG. 12. It is assumed that ink is introduced into the liquid passage wall forming member 107 by flowing in the direction shown by the thick arrow in the figure. Further, between the recess 1105*b* in the isolating film 1105*a* and the displacing plate 1106 is formed a void having a height equal to or larger than the distance over which the displacing plate 1106 can be displaced or deformed. As in the case with the above embodiment, an ink supply passage 110 for supplying ink to the ink jet head is formed by directly punching a silicon substrate by a sand blast process, an ICP (Inductively Coupled Plasma) process, an anisotropic etching process, or the like.

Figure 14:
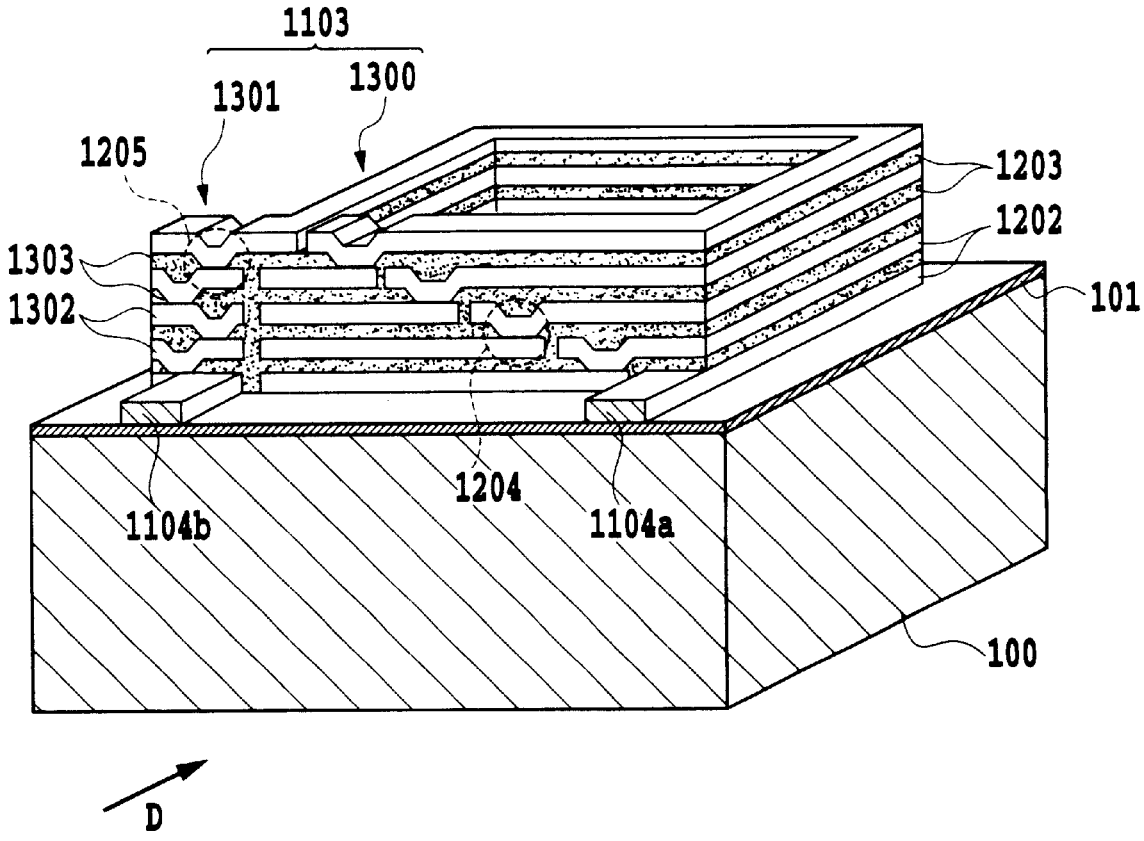
FIG. 14 is a perspective view of the thin-film coil and electrode wiring shown in FIG. 12.
Figure 15:
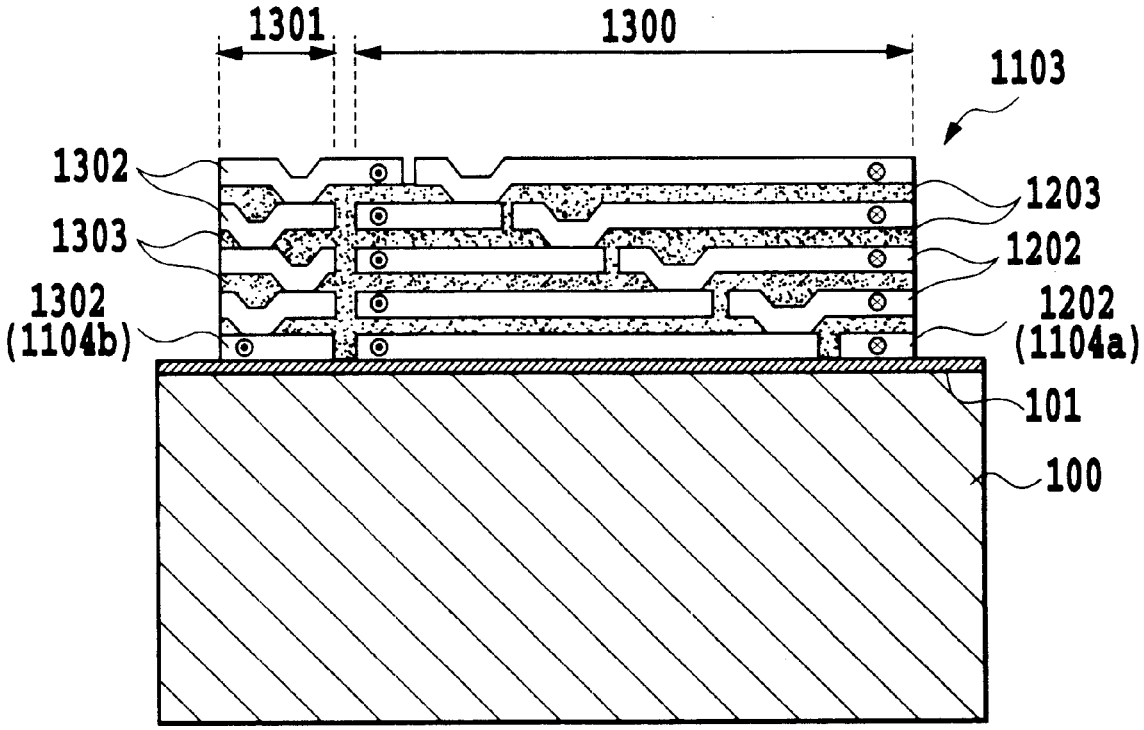
FIG. 15 is a side view of FIG. 14 as viewed from a direction D.

FIG. 14 is a perspective view of the thin-film coil 1103 and the electrode wirings 1104 shown in FIG. 12. FIG. 15 is a side view of FIG. 14 as viewed from a direction D. In these figures, reference numeral 1202 denotes open-loop layers forming the coil 1103, denoted 1203 is an insulating film between the open-loop layers, and denoted 1204 is a via hole contact portion for sequentially connecting each open-loop layer to the one located below. These components constitute the main body 1300 of the coil 1103.

The one electrode wiring 1104*a* is connected directly to the lowermost open-loop layer, while the other electrode wiring 1104*b* is connected to the uppermost open-loop layer via electrode wiring 1301.

The electrode wiring 1301 is provided outside the coil main body 1300 and has a laminated structure similar to that of the coil main body 1300. The electrode wiring 1301 has electrode layers 1302, insulating layers 1303 between the electrode layers, and a via hole contact portion 1250 for sequentially connecting each electrode layer to the one located below. The uppermost electrode layer 1302 connects to the uppermost open-loop layer 1202, while the lowermost electrode layer 1302 connects to the electrode wiring 1104*b*.

With the above construction, when electricity is conducted through the one electric wiring 1104*a*, a current i flows from the symbol "x" to the symbol "○" in the coil main body 1300. That is, the current flows from the lowermost open-loop layer 1202 through the via hole contact portion 1204 to the open-loop layer 1202 located above, and then sequentially flows to the open-loop layer 1202 located above through the via hole contact portion 1204. Then, the current flows from the uppermost open-loop layer 1202 to the uppermost electrode layer 1302 and then sequentially flows to the electrode layer 1302 located below through the via hole contact portion 1204, further flows from the lowermost electrode layer 1302 to the other electric wiring 1104*b*.

An ejecting operation performed by the ink jet head of this embodiment will be described below with reference to FIG. 16.

Figure 16A:
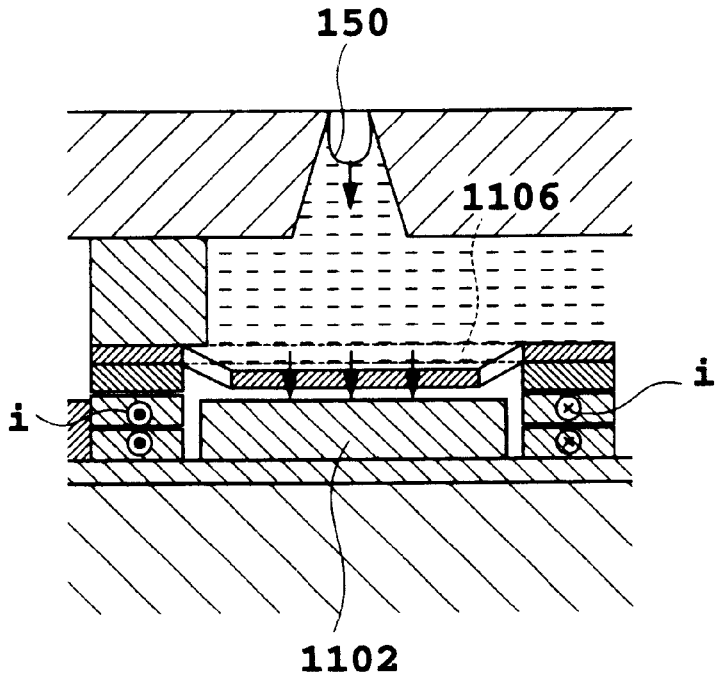
FIGS. 16A and 16B are views useful in describing an ejecting operation performed by an ink jet head having the essential part constructed as shown in FIGS. 12 and 13.
Figure 16A:
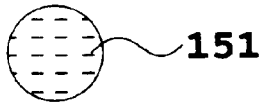
Figure 16B:
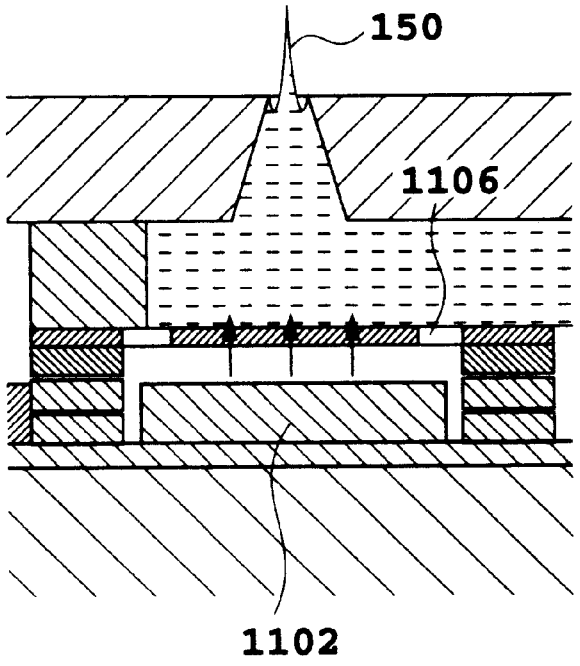

When a current is conducted through the coil 1103 of the actuator 1120 as described above, magnetic force is generated in the axial direction of the core 1102 to deform the displacing plate 1106 in the direction shown by the arrows in FIG. 16A (toward the core). At this time, the ink in the liquid passage responds to the deformation of the deformed plate 1106 to pull meniscus 150 to the interior of the ejection opening.

When the current is interrupted, the displacing plate 1106 moves back to its original position owing to its own elasticity. At this time, the displacing plate 1106 exerts pressure on the ink in the direction shown by the arrows in FIG. 16B to apply kinetic energy to the ink, thereby generating an ink droplet 151, which is separated from the meniscus 150 and fly off through the ejection opening. The ink droplets 151 lands on a printing medium such as paper, a plastic film, a cloth, or the like to form a dot thereon.

By conducting a current of a pulse waveform through the coil 1103 and repeatedly providing this current, continuous ejection is achieved. Further, by varying the power of the provided pulse (pulse width and/or current value), the displacement or deformation of the displacing plate 1106 can be varied. Consequently, differently-sized droplets can be ejected through the ejection opening, thereby enabling the size of dots varied during printing.

(2.3) Component Materials and Manufacture Process

Now, preferred materials used to form the components of the ink jet head of this embodiment will be listed below.

The substrate 100, the insulating film 101, and the liquid passage forming member 107 can be produced using materials and manufacture methods similar to those described above.

The core 1102 of the electromagnet portion may be composed of a ferromagnetic material with a high permeability. Preferred materials include 78.5 Ni—Fe (permalloy), Fe, Co, Ni, silicon steel (Fe-4Si), supermalloy (79N-5Mo-0.3Mn—Fe), and Heussler alloy (65Cu-25Mn-10Al). To form the core 1102 on the substrate 100, an electrodeposition or sputtering process can be used after a high-conductivity thin film of Au is formed in a lower layer of the core material.

The open-loop layers 1202 and the electrode layers 1302 of the coil 1103 are composed of a conductive material such as Cu, Au, or Al. Of these materials, Al is preferred in order to allow these layers to formed in the same step in which drive elements such as transistors are formed on the substrate 100. Further, these layers preferably have a film thickness of about 0.5 to 1 $\mu$m.

If a conductive liquid such as aqueous ink is ejected, the isolating film 1105 and the interlayer films 1203 and 1303 of the coil are preferably insulating thin films made of $SiO_2$, SiN, or the like in order to protect the core 1102 and the coil 1103 from conduction corrosion. However, if a non-conductive liquid such as ink mainly composed an organic solvent is ejected, no practical problems occur even without the isolating film 1105. The isolating film and the interlayer films of the coil can be formed using the thin-film forming process such as the sputtering or CVD process. The interlayer films preferably have a film thickness of about 0.5 to 1 $\mu$m.

Since the displacing plate 1106 is displaced or deformed (vibrated) perpendicularly to the surface thereof, it is preferably composed of a magnetic material having a high permeability. Like the core material, the material of the displacing plate 1106 preferably includes 78.5Ne—Fe (permalloy), Fe, Co, Ni, silicon steel (Fe-4Si), and supermalloy (79N-5Mo—0.3Mn—Fe). If a conductive liquid such as aqueous ink is used, a sandwich structure comprising a magnetic material layer sandwiched between insulating materials such as $SiO_2$ is effective in preventing corrosion resulting from contact with ink.

An explanation will be given of a method of manufacturing the thin-film coil 1103 which constitute an essential part of the ink jet head of this embodiment. This manufacture method is based on a photolithography process comprising a combination of the formation and patterning of thin film. Additionally, in this embodiment, the coil pattern is shaped substantially like a rectangle, but a proper shape such as a circle or an ellipse may be used; the present invention is not limited to the illustrated embodiment.

(1) A layer (insulating layer 101) of $SiO_2$ with a thickness of 1 $\mu$m is formed on a surface of the silicon substrate 100 by sputtering (not shown). Then, a layer of Al with a thickness of 1 $\mu$m is formed by sputtering.

Figures 17A, 17B, 17C, 17D, 17E:
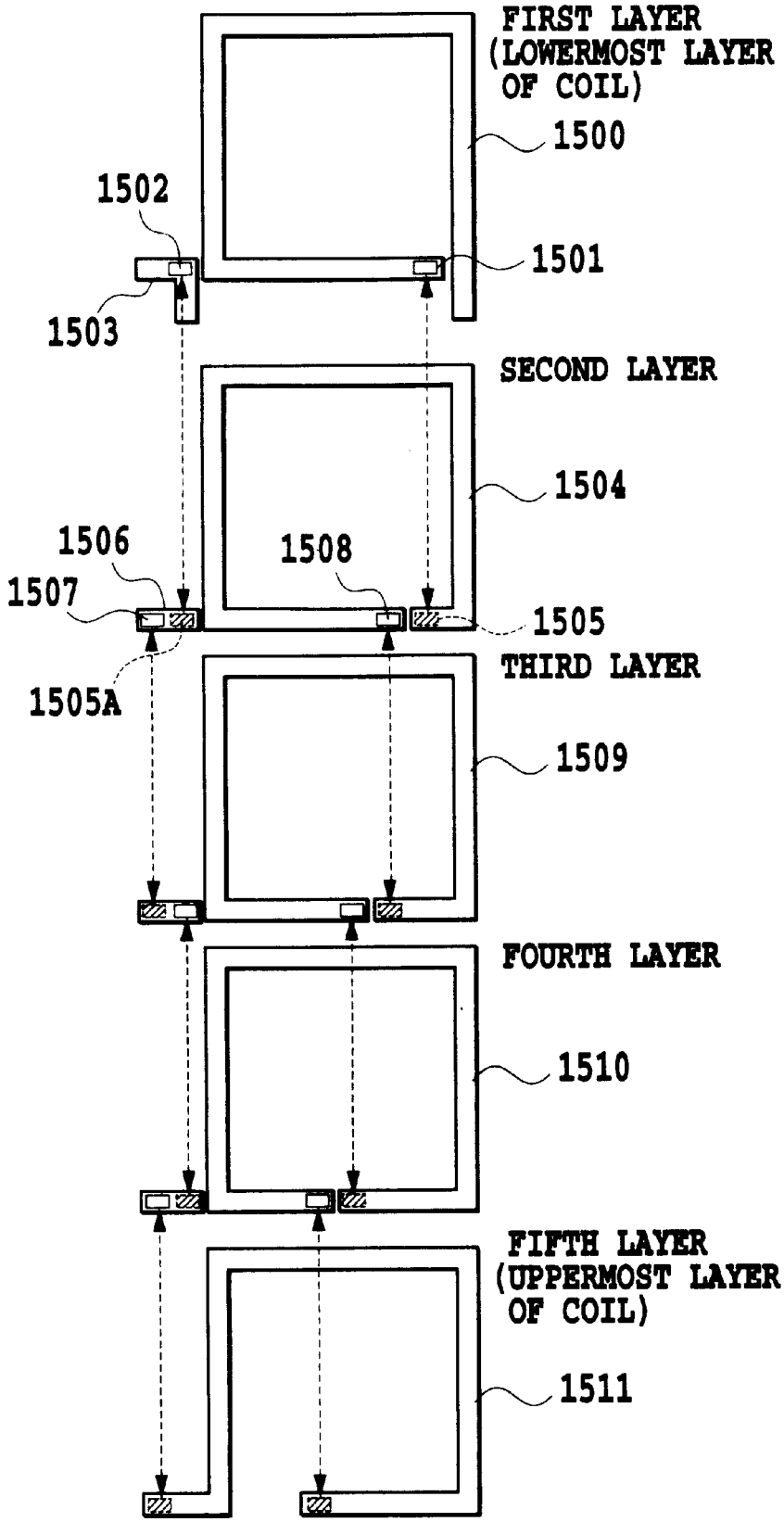
FIGS. 17A to 17E are views useful in specifically describing a process of forming the thin-film coil, included in the essential part of the ink jet head shown in FIGS. 12 and 13.

Then, a pattern 1500 of a first layer of the coil (open-loop layer 1202) which includes the one electrode wiring and a pattern 1503 of a first layer of the external wiring (electrode layer 1302) which includes the other electrode wiring are formed by photolithography method (FIG. 17A).

(2) A layer of $SiO_2$ with a thickness of 0.5$\mu$m is formed by sputtering as an interlayer insulating film (not shown). Then, using a photolithography process, a via hole 1501 is opened on the first layer of the coil, and a via hole 1502 is opened on the first layer of the external wiring (FIG. 7A).

(3) A second layer of an Al film is formed by sputtering, and a coil pattern 1504 and an external wiring 1506 are formed by photolithography. This step allows the open-loop layer and electrode layer in the first layer are connected through via contact holes 1505 and 1505A to the open-loop layer and electrode layer in the second layer, respectively (FIG. 17B).

(4) A layer of $SiO_2$ with a thickness of 0.5$\mu$m is formed by sputtering as an interlayer insulating film (not shown). Then, using a photolithography process, a via hole 1508 is opened on the second layer of the coil, and via hole 1507 is opened on the second layer of the external wiring (FIG. 17B).

(5) Steps similar to the above steps (3) and (4) are repeated a predetermined number of times to form coil patterns 1509, 1510, and 1511 and electrode layers (FIGS. 17C to 17E).

Figure 18:
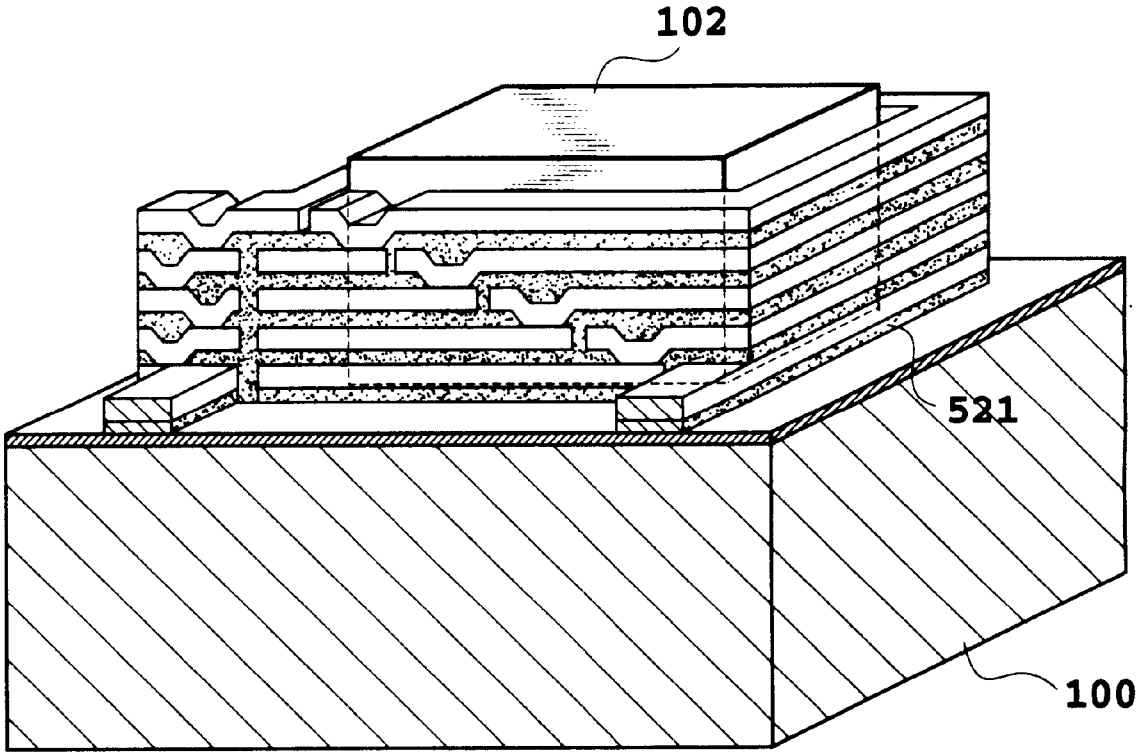
FIGS. 18 are views useful in specifically describing a process of forming a core included in the essential part of the ink jet head shown in FIGS. 12 and 13.

The coil 1103 of this embodiment having the desired laminated structure can be formed using the above steps, while the core 1102, located inside the coil 1103, can be formed by applying the procedure of the steps 1 to 3, described in connection with FIGS. 4A to 4C, as a preprocess. Here, its formation aspect will be described. FIG. 18 is a perspective view showing the coil 1103 of this embodiment and the core 1102, formed inside the coil 1103. The illustrated core 1102 can be formed by building-up the core material by electrodeposition. To achieve this, a conductive film 1521 of Au is formed in a lower part of the wiring corresponding to its lowermost layer, so as to have a thickness of 0.1$\mu$m. Then, the conductive film 1521 is used as an electrode to bathe the structure with an electroplating bath (for example, a sulfuric acid bath (bath temperature: 50 to 60° C.) using an NF-200E manufactured by Kojundo Chemical Laboratory Co., Ltd.) while supplying power thereto at a current density of 2 to 6A/dm$^2$, thereby forming the core 1102.

Subsequently, the coil 1103 is formed as shown in FIGS. 17A to 17E to obtain the construction shown in FIG. 18, so that the coil 1103 and the core 1102 can function as small thin-film electromagnet.

After the coil has been formed, the procedure of the steps 6 to 12, described in connection with FIGS. 5A to 5E, 6A to 6E, and 7A to 7E, is applied to complete the essential part of the ink jet head.

Further, the ink jet head portion 410 or ink jet head unit shown in FIG. 8 is obtained by forming a plurality of actuators 1120 on the same substrate during the same step and arranging the liquid passage forming member and the integrated orifice plate 400 with the actuators.

Furthermore, this ink jet head unit can be used in the ink jet printing apparatus described in connection with FIG. 9.

(2.4) Evaluation of Operations

A head portion having an essential part such as the one constructed as shown in FIG. 13 and having the actuators and the ejection openings arranged at a pitch of 150 dpi each column as shown in FIG. 8 is supplied with aqueous ink composed of 70% of water, 25% of ethylene glycol, and the remaining 5% of dye and having a viscosity of 2.5 mPa·s. Then, the current pulse shown in FIG. 11A are applied to the ink jet head at a period of 50 Hz, and the state of ejection is observed.

When the ink was continuously ejected, the size of ejected droplets was constant and no variation in the ejection speed was observed. Furthermore, when the current pulses shown in FIG. 11B were used to drive the ink jet head, the "pulse A" enabled large droplets to be stably ejected, while the "pulse B" enabled small droplets to be stably ejected, indicating the possibility of gradation based on dots.

In this embodiment, the ink jet head was used to continuously eject ink for 24 hours, but the ejection remained stable. This indicates that in this thin-film coil, the external wiring and the power supply line are stably connected together.

(2.5) Another Example of a Construction of the Essential Part of the Ink Jet Head Next, another embodiment of a construction of a thin-film coil having a multilayered structure will be described. In the above embodiment, the coil pattern has one turn in each layer, but may have a plurality of turns therein.

Figures 19A, 19B:
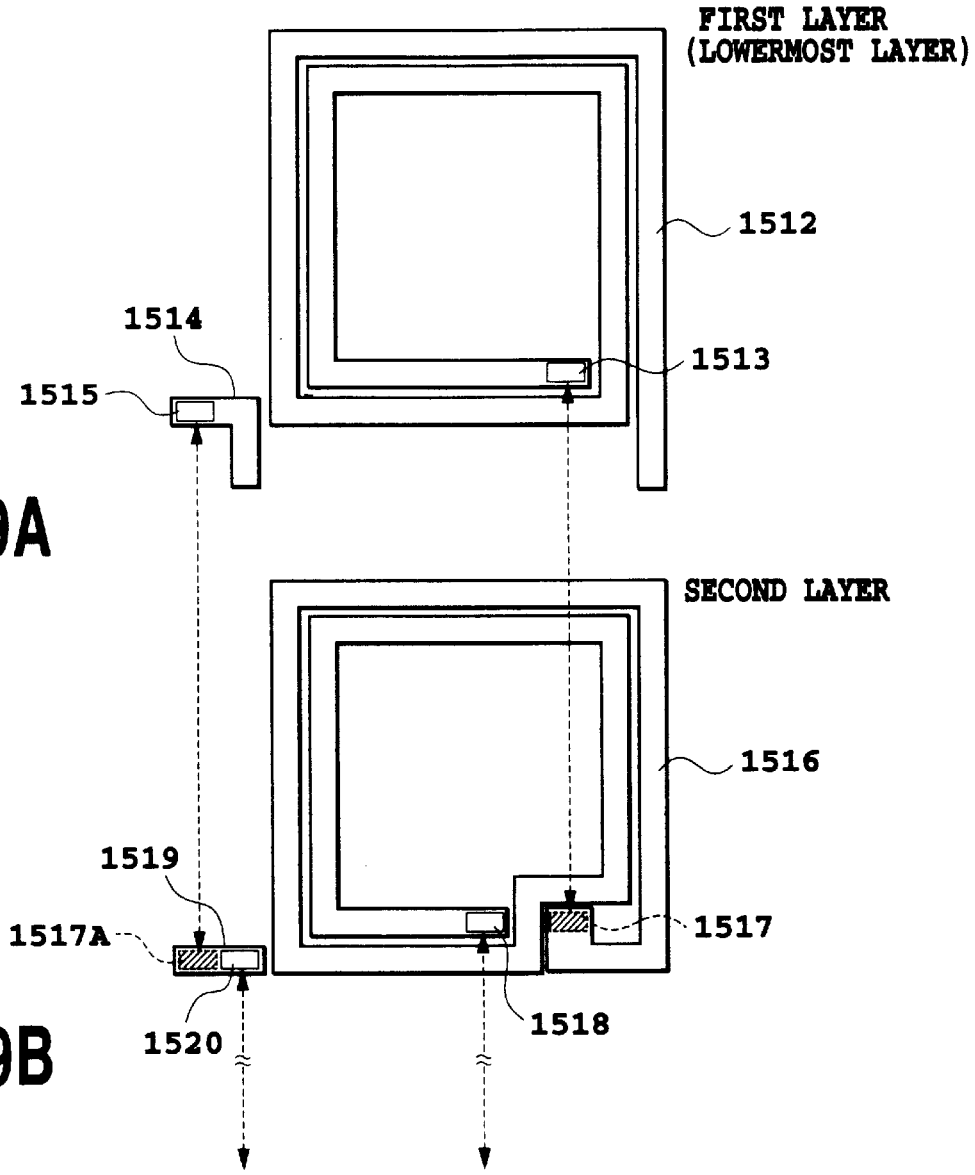
FIGS. 19A and 19B are views useful in describing an embodiment of a multilayered coil having a plurality of turns in each layer.

FIG. 19 is a view useful in describing a coil with a coil pattern having two turns in each layer. A first layer is composed of a rectangularly spiral coil pattern 1512 and an external wiring pattern (electrode layer) 1514. Furthermore, an interlayer insulating film (not shown) is arranged thereon, and via holes 1513 and 1515 are opened in the coil (FIG. 19A).

Next, a rectangularly spiral pattern 1516 of a second layer is disposed at a location where it can be connected to the first layer through the via hole contact, and is shaped so that the current flows through the second layer in the same direction as that in the first layer. In the embodiment in FIG. 19, the spiral coil pattern and the electrode layer of the first layer is connected to the spiral coil pattern and the electrode layer of the second layer through via hole contacts 1517 and 1517A, respectively (FIG. 19B). Reference numerals 1518 and 1520 denote via holes formed in an interlayer insulating film (not shown) if additional layers are further laminated on the coil. Thus, a procedure similar to the one described above can be repeated to manufacture a coil of a multilayered structure having a rectangularly spiral coil pattern in each layer.

Figures 20A, 20B:
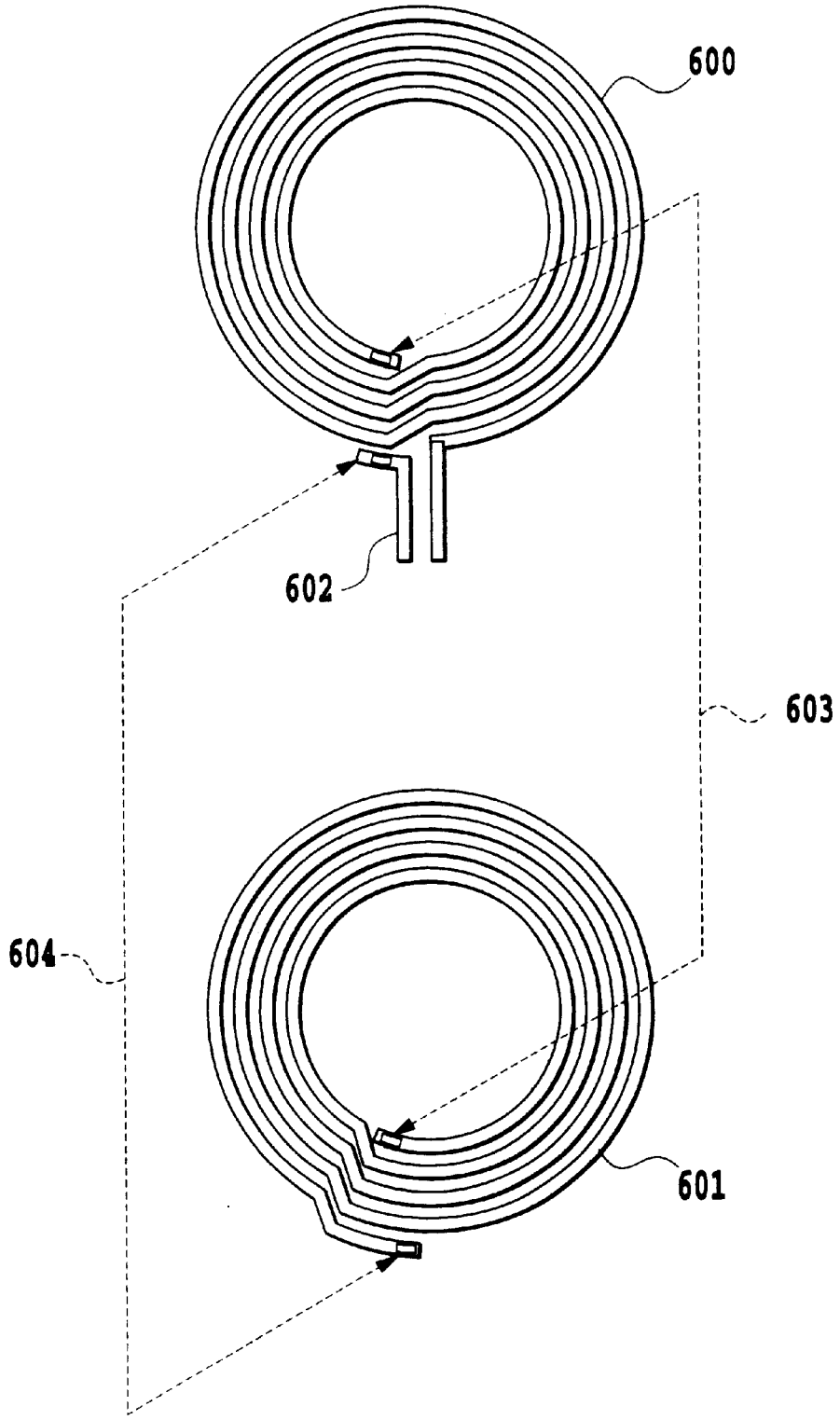
FIGS. 20A and 20B are views useful in describing another embodiment of a multilayered coil having a plurality of turns in each layer.

FIG. 20 is a view useful in describing a two-layer coil with a circularly spiral coil pattern having four turns in each layer. In this figure, the thin-film coil has a suitable shape for forming a densely wound coil. A circularly spiral pattern 1600 of a first layer is formed as shown in FIG. 20A, while a pattern 1602 of an external wiring layer is formed at the illustrated location. Furthermore, an interlayer insulating film (not shown) is arranged thereon, and via holes are formed in the coil.

Next, by forming a circularly spiral coil pattern 1601 of a second layer as shown in FIG. 20B, the coil patterns of the first and second layers are connected together through a via hole contact 1603, and the second layer is connected to the external wiring through a via hole contact 1604.

3. Other Embodiments

In the above description, pressure required to eject ink is exerted by the attraction/returning of the displacing plate to the electromagnet associated with the application/elimination of magnetic force carried out by conducting/interrupting current through the electromagnet. However, as long as sufficient pressure is obtained, for example, a displacing plate magnetized by properly setting polarities therefor may be used and displaced by subjecting it to repulsive force associated with magnetic force generated by conducting current through the electromagnet, thereby ejecting ink.

Further, in this specification, the term "print" does not only refer to the formation of significant information such as characters and graphics but also extensively refers to the formation images, patterns, and the like on printing media or the processing of printing media whether the information is significant or not or whether it is embodied so as to be visually perceived by human beings or not.

Furthermore, the term "printing apparatus" refers not only to one complete apparatus that executes printing but also to an apparatus that contributes to achieving a printing function.

The term "printing medium" or "printing sheet" include not only paper used in common printing apparatus, but cloth, plastic films, metal plates, glass, ceramics, wood, leather or any other material that can receive ink.

Further, the term "ink" or "liquid" should be interpreted in its wide sense as with the term "print" and refers to liquid that is applied to the printing medium to form images, designs or patterns, process the printing medium or process ink (for example, coagulate or make insoluble a colorant in the ink applied to the printing medium).

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing heater elements, and means for carrying out preliminary ejection of ink independently of the ejection for printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Moreover, the multilayered structure, structure for connecting to external wiring, and manufacture method therefor according to the embodiments described in connection with FIGS. 12 to 20 are not only applicable to the above-described ink jet head or the manufacture method therefor but are also extensively applicable to small-sized coils, devices using such coils (magnetic heads or the like), or manufacture methods therefor.

As described above, the present invention employs a method of ejecting ink using magnetic force generated by an actuator that uses a single- or multi-layered thin-film coil, thereby achieving the improvement of ejection stability and power, which has been a requirement for the conventional ink jet heads, and obtaining wide dot-based gradation. Further, an actuator on which electromagnetic force acts or an ink jet head which is an essential part of an ejection method using electromagnetic force is manufactured using a photolithography or micromachining process, thereby enabling a large number of ejection openings to be densely mounted. These features make it possible to print high-definition images at a high speed so that the images can maintain stable quality over time.

Furthermore, according to the coil structure of the present invention, the coil structure can be more reliably connected to external wiring even with an increase in the number of turns in the thin-film coil.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet head comprising:

an electromagnet portion having a core provided on a substrate and a thin-film coil provided on said substrate so as to surround said core and having at least one turn; and a displacing portion located opposite said electromagnet portion, supported so as to be partially displaceable by magnetic force generated by said electromagnet portion in response to electric conduction, and for causing ink to be ejected in response to pressure resulting from the displacement.

2. An ink jet head as claimed in claim 1, further comprising an isolating member for isolating said electromagnet portion from the ink and on which a void is formed for permitting said displacement.

3. An ink jet head as claimed in claim 1, wherein said displacing portion has a plate-shaped main body composed of a material that can be deformed by said magnetic force and protective films that sandwich said main body therebetween in order to protect said main body from said ink.

4. An ink jet head as claimed in claim 1, wherein pressure required to eject said ink is exerted by attraction/returning of said displacing portion associated with application/elimination of the magnetic force carried out by conducting/interrupting current through said electromagnet portion.

5. An ink jet head as claimed in claim 1, wherein said displacing portion is provided in a liquid passage communicated with a ejection opening through which the ink is ejected substantially perpendicularly to a direction of said displacement.

6. An ink jet head as claimed in claim 1, wherein said displacing portion is provided in a liquid passage communicated with a ejection opening through which the ink is ejected in a direction substantially parallel to a direction of said displacement.

7. An ink jet head as claimed in claim 1, wherein a plurality of said electromagnet portions, a plurality of said displacing portions, and a plurality of said ejection openings for ejecting the ink are provided on the same substrate.

8. An ink jet head as claimed in claim 1, wherein said ink jet head is integrated with an ink tank for supplying ink.

9. An ink jet printing apparatus for executing printing on a printing medium using an ink jet head, said apparatus comprising:

means for relatively scanning said ink jet head and said printing medium, and said ink jet head having:

an electromagnet portion having a core provided on a substrate and a thin-film coil provided on said substrate so as to surround the core and having at least one turn; and a displacing portion located opposite the electromagnet portion, supported so as to be partially displaceable by magnetic force generated by said electromagnet portion in response to electric conduction, and for causing ink to be ejected in response to pressure resulting from the displacement.

10. A method of manufacturing an ink jet head, the method comprising the steps of:

forming said core on a substrate;

forming a thin-film coil on said substrate so as to surround said core; and disposing a displacing portion opposite said core, said displacing portion being partially displaceable by magnetic force and for causing ink to be ejected in response to pressure resulting from the displacement.

11. A method of manufacturing an ink jet head as claimed in claim 10, wherein a three-dimensional structure including said thin-film coil and said displacing portion is formed on said substrate composed of silicon, by a combination of a wet photolithography process and a dry photolithography process.

12. An ink jet head comprising:

an electromagnet portion formed on a substrate; and a displacing portion located opposite the electromagnet portion, supported so as to be partially displaceable by magnetic force generated by said electromagnet portion in response to electric conduction, and for causing ink to be ejected in response to pressure resulting from the displacement, and wherein said electromagnet portion has a core provided on said substrate and a thin-film coil provided on said substrate so as to surround said core, said thin-film coil has a multilayered structure in which a plurality of coil patterns each having at least one turn in substantially the same plane are laminated via insulating layers, and a winding structure in which said coil patterns are sequentially connected through via hole contacts.

13. An ink jet head as claimed in claim 12, wherein said thin-film coil and external wirings are connected together in substantially the same plane as that of the coil pattern of a lowermost layer facing said substrate.

14. An ink jet head as claimed in claim 13, wherein an electrode wiring for connecting said coil with one of said external wirings is provided on said substrate so as to be directly connected to the coil pattern of the lowermost layer facing said substrate, and another electrode wiring for connecting the coil pattern of an uppermost layer that is most distant from said substrate with the other of said external wirings has a multilayered structure in which a plurality of electrode layers are laminated on said substrate via insulating layers, and said electrode layers are electrically connected sequentially through the via hole contacts and connected to the other of said external wirings via the electrode layer of a lowermost layer facing said substrate.

15. An ink jet head as claimed in claim 12, further comprising an isolating member for isolating said electromagnet portion from the ink and on which a void is formed for permitting said displacement.

16. An ink jet head as claimed in claim 12, wherein said displacing portion has a plate-shaped main body composed of a material that can be deformed by said magnetic force and protective films that sandwich said main body therebetween in order to protect said main body from said ink.

17. An ink jet head as claimed in claim 12, wherein pressure required to eject said ink is exerted by attraction/returning of said displacing portion associated with application/elimination of the magnetic force carried out by conducting/interrupting current through said electromagnet portion.

18. An ink jet head as claimed in claim 12, wherein said displacing portion is provided in a liquid passage communicated with a ejection opening through which the ink is ejected substantially perpendicularly to a direction of said displacement.

19. An ink jet head as claimed in claim 12, wherein said displacing portion is provided in a liquid passage communicated with a ejection opening through which the ink is ejected in a direction substantially parallel to a direction of said displacement.

20. An ink jet head as claimed in claim 12, wherein a plurality of said electromagnet portions, a plurality of said displacing portions, and a plurality of said ejection openings for ejecting the ink are provided on the same substrate.

21. An ink jet head as claimed in claim 12, wherein said ink jet head is integrated with an ink tank for supplying ink.

22. An ink jet printing apparatus for executing printing on a printing medium using an ink jet head, said apparatus comprising:

means for relatively scanning said ink jet head and said printing medium, and said ink jet head having:

an electromagnet portion formed on a substrate; and a displacing portion located opposite the electromagnet portion, supported so as to be partially displaceable by magnetic force generated by said electromagnet portion in response to electric conduction, and for causing ink to be ejected in response to pressure resulting from the displacement, and wherein said electromagnet portion has a core provided on said substrate and a thin-film coil provided on said substrate so as to surround said core, said thin-film coil has a multilayered structure in which a plurality of coil patterns each having at least one turn in substantially the same plane are laminated via insulating layers, and a winding structure in which said oil patterns are connected sequentially through via hole contacts.

23. A method of manufacturing an ink jet head, the method comprising the steps of:

forming said core on a substrate;

forming a thin-film coil by laminating a plurality of coil patterns each having at least one turn in substantially the same plane so as to surround said core are laminated via insulating layers, while sequentially connecting said coil patterns through via hole contacts; and disposing a displacing portion opposite said core, said displacing portion being partially displaceable by magnetic force and for causing ink to be ejected in response to pressure resulting from the displacement.

24. A method of manufacturing an ink jet head as claimed in claim 23, further comprising the steps of:

forming an electrode wiring for connecting said thin-film coil wit h one of said external wirings on said substrate so as to be directly connected to the coil pattern of a lowermost layer facing said substrate, and forming another electrode wiring for connecting said thin-film coil with the other of said external wirings simultaneously with the f forming step of said thin-film coil, y laminating a plurality of electrode layers on said substrate via insulating layers so as to connect a lowermost electrode layer facing said substrate with the other of said external wirings and to connect an uppermost electrode layer with connect the coil pattern of an uppermost layer, while sequentially connecting electrode layers through via hole contacts.

25. A thin-film coil having a multilayered structure in which a plurality of coil patterns each having at least one turn in substantially the same plane are laminated via insulating layers, and a winding structure in which said coil patterns are connected sequentially through via hole contacts;

wherein an electrode wiring for connecting said coil with one of said external wirings is provided on said substrate so as to be directly connected to the coil pattern of the lowermost layer facing said substrate, and wherein another electrode wiring for connecting the coil pattern of an uppermost layer that is most distant from said substrate with the other of said external wirings has a multilayered structure in which a plurality of electrode layers are laminated on said substrate via insulating layers, and said electrode layers are electrically connected sequentially through the via hole contacts and connected to the other of said external wirings via the electrode layer of a lowermost layer facing said substrate.

26. A method of manufacturing a thin-film coil, said method comprising the steps of:

forming a thin-film coil main body by laminating a plurality of coil patterns each having at least one turn in substantially the same plane, while sequentially connecting said coil patterns through via hole contacts;

forming an electrode wiring for connecting said thin-film coil with one of said external wirings on said substrate so as to be directly connected to the coil pattern of a lowermost layer facing said substrate; and forming another electrode wiring for connecting said thin-film coil main body with the other of said external wirings simultaneously with the forming step of said thin-film coil main body, by laminating a plurality of electrode layers on said substrate via insulating layers so as to connect a lowermost electrode layer facing said substrate with the other of said external wirings and to connect an uppermost electrode layer with connect the coil pattern of an uppermost layer, while sequentially connecting electrode layers through via hole contacts.

* * * * *

UNITED STATES PATENT AND TRADEMARK OFFICE

CERTIFICATE OF CORRECTION

PATENT NO. : 6,517,193 B2
DATED : February 11, 2003
INVENTOR(S) : Isao Kimura

It is certified that error appears in the above-identified patent and that said Letters Patent is hereby corrected as shown below:

Title page,
Item [56], References Cited, OTHER PUBLICATIONS, after "Patent Abstracts of Japan, vol. 004,": "08," should read -- 19, --.

Column 4,
Lines 20 and 40, "an" should read -- a --; and
Line 57, "with connect" should read -- with --.

Column 5,
Line 14, "an" should read -- a --.

Column 8,
Line 38, "phororesist" should read -- photoresist --.

Column 9,
Line 40, "50m" should read -- 50μm --.

Column 10,
Line 23, "connected" should read -- connected a --; and
Line 66, "an" should read -- a --.

Column 13,
Line 26, "an liquid" should read -- a liquid --; and
Line 46, "a" should read -- an --.

Column 16,
Line 33, "as" should read -- as a --.

Column 19,
Line 45, "a" should read -- an --; and
Line 50, "a" should read -- an --.

Column 21,
Line 9, "a" should read -- an --;
Line 14, "a" should read -- an --; and
Line 47, "said" should read -- a --.

UNITED STATES PATENT AND TRADEMARK OFFICE

CERTIFICATE OF CORRECTION

PATENT NO. : 6,517,193 B2
DATED : February 11, 2003
INVENTOR(S) : Isao Kimura

It is certified that error appears in the above-identified patent and that said Letters Patent is hereby corrected as shown below:

Column 22,
Line 8, "y" should read -- by --.

Signed and Sealed this

Sixteenth Day of December, 2003

JAMES E. ROGAN
*Director of the United States Patent and Trademark Office*